US011609066B1

(12) United States Patent
Newby et al.

(10) Patent No.: US 11,609,066 B1
(45) Date of Patent: Mar. 21, 2023

(54) FOLDING STOCK ADAPTER

(71) Applicant: MB Machine LLC, Myrtle Beach, SC (US)

(72) Inventors: Sylvan Newby, N. Myrtle Beach, SC (US); Delmar Dean Pullen, Henderson, IA (US); Kevin Grover, Conway, SC (US)

(73) Assignee: MB Machine LLC, Myrtle Beach, SC (US)

( * ) Notice: Subject to any disclaimer, the term of this patent is extended or adjusted under 35 U.S.C. 154(b) by 0 days.

(21) Appl. No.: 17/987,084

(22) Filed: Nov. 15, 2022

(51) Int. Cl.
*F41C 23/04* (2006.01)

(52) U.S. Cl.
CPC ..... *F41C 23/04* (2013.01)

(58) Field of Classification Search
CPC ..... F41C 23/14; F41C 23/04; F41A 11/04
USPC ..... 42/75.03, 73, 71.01
See application file for complete search history.

(56) References Cited

U.S. PATENT DOCUMENTS 8,631,601 B2 * 1/2014 Langevin ..... F41C 23/04 42/73
8,769,855 B2 * 7/2014 Law ..... F41A 11/04 42/73
8,991,088 B1 * 3/2015 Young ..... F41C 23/04 42/75.03
9,719,754 B2 8/2017 Law
10,113,832 B2 10/2018 Law
10,371,474 B2 * 8/2019 Young ..... F41A 11/04
10,704,848 B1 * 7/2020 Zeider ..... F41A 3/66
11,143,470 B1 * 10/2021 Roth ..... F41A 3/66
11,499,795 B2 11/2022 Law
2006/0242880 A1 * 11/2006 Griffin ..... F41C 23/04 42/73
2011/0131857 A1 * 6/2011 Kuczynko ..... F41C 23/04 42/73
2013/0212920 A1 * 8/2013 Law ..... F41A 11/04 42/75.03
2019/0339038 A1 11/2019 Law

OTHER PUBLICATIONS

MB Machine LLC D/B/A Sylvan Arms, "AR15 & AR9 Folding Stock Adapter Gen. 3", website, available at: https://sylvanarms.com/product/arh300/; last accessed on Nov. 15, 2022; all pages.
MB Machine LLC D/B/A Sylvan Arms, Products Page, website, available at: https://sylvanarms.com/shop/; last accessed on Nov. 15, 2022; pp. 1 and 2.

(Continued)

*Primary Examiner* — Michael D David
(74) *Attorney, Agent, or Firm* — Maskell Law PLLC; Benjamin E. Maskell

(57) ABSTRACT

Disclosed is a connector for hingedly mounting a buttstock to a receiver of a rifle. The connector has a fixed hinge portion, a receiver side of the fixed hinge portion, an interface side of the fixed hinge portion, a threaded protrusion extending from the receiver side of the fixed hinge portion, a buffer hole extending from the interface side, through the fixed hinge portion, and through the threaded protrusion, a tube lock hole extending from the interface side, through the fixed hinge portion, to the receiver side, and a lock screw sized in relative proportions to be threadably received in the tube lock hole.

19 Claims, 15 Drawing Sheets

(56) References Cited

OTHER PUBLICATIONS

Law Tactical; "AR Folding Stock Adapter Gen 3-M", website, available at: https://www.lawtactical.com/ar_folding_stock_adapter_gen_3_m_p/99312.htm; last accessed on Nov. 15, 2022; all pages.

* cited by examiner

FOLDING STOCK ADAPTER

BACKGROUND OF THE INVENTION

Field of the Invention

The embodiments of the invention relate a folding stock adapter for a rifle, and more particularly, to a hinge that can be mounted between the receiver and the buttstock of a rifle that permits the buttstock to fold with respect to the receiver. Although embodiments of the invention are suitable for a wide scope of applications, it is particularly suitable for folding the stock of an AR platform rifle.

Discussion of the Related Art

The related art includes U.S. Pat. No. 8,769,855 to Zachary Law ("Law Hinge"). The Law Hinge discloses, generally, a two-part hinge for attaching a buttstock to a receiver of a rifle. A first half the Law Hinge attaches to the receiver and a second half of the Law Hinge attaches to the buffer tube which is in turn connected to the buttstock. The first half of the Law Hinge includes a latch that retains the bolt carrier group and an extension when the hinge is in an open position and releases the bolt carrier group and an extension when in the hinge is in the closed position. The latch mechanism of the Law Hinge is assembled by inserting the latch and a spring into an appropriately sized hole near the hinge pin. A cover retains the latch in the hole.

The Law Hinge is connected to the receiver by a "threaded flange." A threaded portion of the threaded flange is threaded to be compatible with a threaded hole on the rear of the receiver that would normally receive the buffer tube. The threaded portion is slightly smaller than a bore hole through the center of the Law Hinge and a ring-shaped protrusion of the threaded portion forms a head or a flange that is slightly larger than the bore hole. The Law Hinge is attached to the receiver by first placing the hinge against the receiver and then inserting the threaded portion of the threaded flange through the borehole into the threaded hole on the rear of the receiver. The threaded flange is tightened until the head of the threaded flange catches a sidewall of the borehole. Continued tightening of the threaded flange firmly secures the hinge to the receiver.

There are numerous shortcomings, however, of the Law Hinge. Among other things, the tightening the threaded flange of the Law Hinge requires a special tool and a high degree of manual dexterity. Additionally, AR platform rifles include a takedown pin and spring that is normally accessible through rear of the receiver. A user installing a Law Hinge must take precaution to secure the takedown pin and spring while positioning and installing the Law Hinge. This requires still additional dexterity and can be a frustrating and cumbersome experience. Additionally, because the latch of the Law Hinge is installed through a hole near the hinge pin, the Law Hinge is weakened at that important location.

SUMMARY OF THE INVENTION

Accordingly, embodiments of the invention are directed to a folding stock adapter that substantially obviates one or more of the problems due to limitations and disadvantages of the related art.

An object of embodiments of the invention is to provide a folding stock adapter that facilitates easy installation of the takedown pin and spring.

Another object of embodiments of the invention is to provide a folding stock adapter that has latch components that have improved strength.

Yet another object of embodiments of the invention is to provide improved latch assembly that does not weaken an area near the pivot of the hinge.

Still another object of embodiments of the invention is to provide latch components that are optimized to reduce play and compensate for imprecisions.

Another object of embodiments of the invention is to provide a durable and smooth locking mechanism to retain the hinge in an open position.

Yet another object of embodiments of the invention is to provide folding stock adapter that can be attached to a receiver with ordinary tools and minimal dexterity.

Additional features and advantages of embodiments of the invention will be set forth in the description which follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

To achieve these and other advantages and in accordance with the purpose of embodiments of the invention, as embodied and broadly described, folding stock adapter includes a fixed hinge portion, a receiver side of the fixed hinge portion, an interface side of the fixed hinge portion, a threaded protrusion extending from the receiver side of the fixed hinge portion, a buffer hole extending from the interface side, through the fixed hinge portion, and through the threaded protrusion, a tube lock hole extending from the interface side, through the fixed hinge portion, to the receiver side, and a lock screw sized in relative proportions to be threadably received in the tube lock hole.

In another aspect, folding stock adapter includes a fixed hinge portion, a swinging hinge portion, a hinge pin rotably connecting the fixed hinge portion to the swinging hinge portion, and a latch selectively connecting the fixed hinge portion to the swinging hinge portion. The latch has a gate hole orthogonal to and on an opposite side from the hinge pin, a gate slidably disposed in the gate hole, a gate stop partially covering the gate hole and slidably retaining the gate in the gate hole, a bolt hole orthogonally intersecting the gate hole, and a bolt sized in relative proportions to be received in the bolt hole and selectively retained by the gate.

In yet another aspect, folding stock adapter includes a fixed hinge portion, a receiver side of the fixed hinge portion, an interface side of the fixed hinge portion, a threaded protrusion extending from the receiver side of the fixed hinge portion, a buffer hole extending from the interface side, through the fixed hinge portion, and through the threaded protrusion, a tube lock hole parallel to the buffer hole and extending from the interface side, through the fixed hinge portion, to the receiver side, and a takedown spring hole parallel to the buffer hole and extending from the interface side, through the fixed hinge portion, to the receiver side.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of embodiments of the invention and are incorporated in and constitute a part of this specification, illustrate embodiments of the invention and together with the description serve to explain the principles of embodiments of the invention.

DETAILED DESCRIPTION OF THE PREFERRED EMBODIMENTS

Figure 1A:
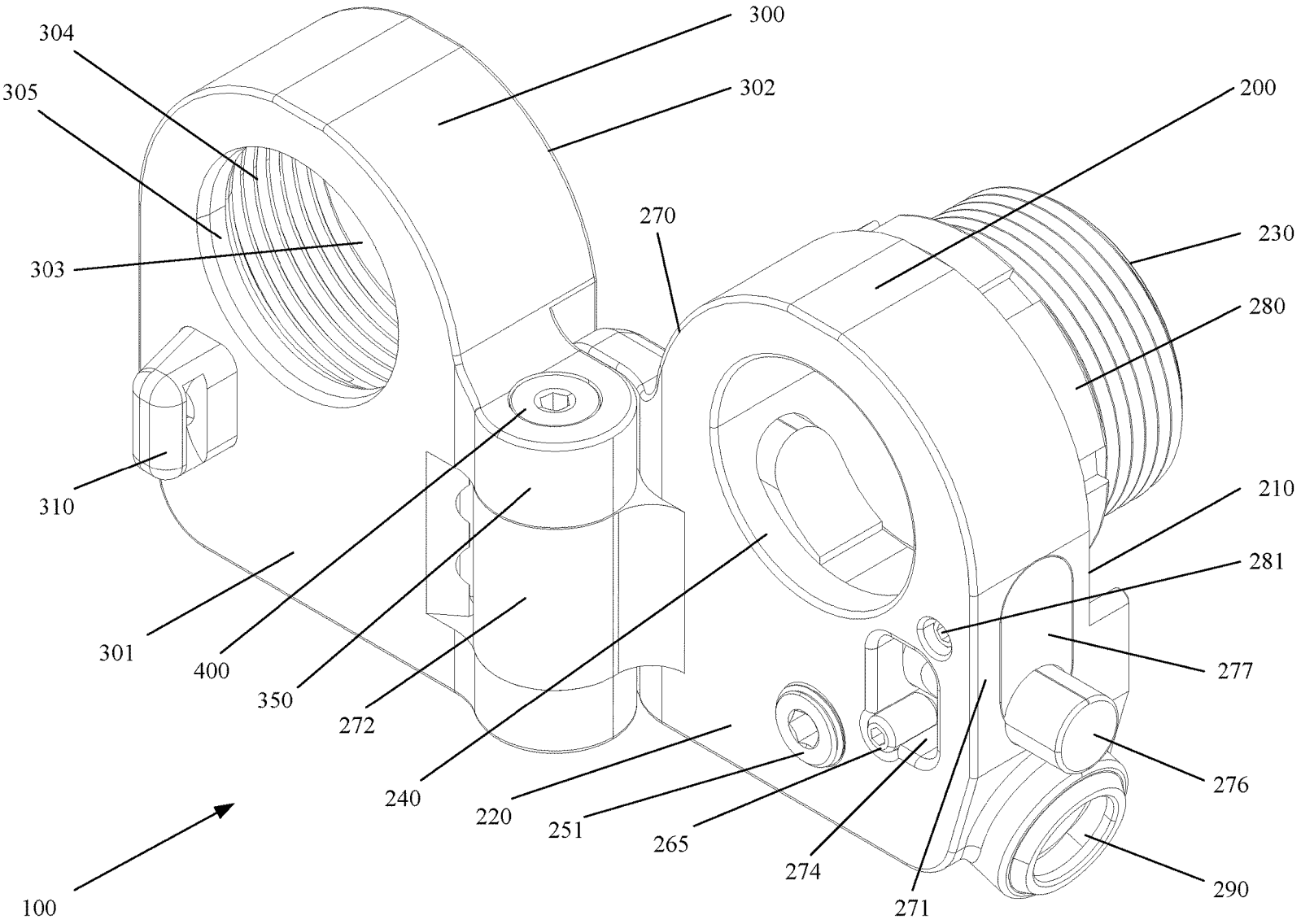
FIG. 1A is an isometric view of a folding stock adapter according to an exemplary embodiment of the invention.

Reference will now be made in detail to the preferred embodiments of the invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art. In the drawings, the thicknesses of layers and regions are exaggerated for clarity. Like reference numerals in the drawings denote like elements.

Generally, the invention relates to a two-part hinge that can be mounted between a receiver and buttstock of a rifle. The hinge can be disposed in a closed position such that the inner faces of the two-part hinge are adjacent and the buttstock and rifle are in a line and ready to fire. The hinge can also be disposed in an open position where the inner faces of the two-part hinge are hinged away from one another and the buttstock is folded along side a receiver of the rifle. The device can be attached to a rifle by removing a buffer tube of the rifle and attaching one half of two-part hinge at the attachment location for the buffer tube. The buffer tube can then be attached to the other half of the two-part hinge and the buttstock can be attached to the buffer tube. A latch can releasably retain the two-part hinge in the closed position.

The description of the invention may refer to parts of the invention in relative terms such as left, right, top, bottom, front, back, etc. These terms can be construed in context with respect to the drawings that the terms are used to describe. Thus, the term "left" used in conjunction with FIG. 1A would generally mean the left side of the referenced item as shown in FIG. 1A unless context requires otherwise. The description of the invention may also refer to holes, notches, channels, grooves, recesses, cutouts, and other structural features. These terms are used in the context that best describes the corresponding drawings, but are not intended to be limiting or exclusive. By way of example, the term "hole" does not exclude a "recess" and vice versa. By way of a second example, the term "channel" does not exclude a "groove" or a "notch." Accordingly, each of these terms should be given the broadest reasonable interpretation in view of the disclosure herein when viewed as a hole and including such variation and modification as those of skill in the art would appreciate are equivalents thereof.

The description of the invention may also refer to the location of features in respect to the location of other items or features. For example, the description includes various references to a "receiver side" which, in context, means the side closest to where the folding hinge adapter is designed to connect to receiver of a rifle. Similarly, the description also includes various references to "interface surfaces" which, in context, refers to the inner surfaces of the two hinge parts. The description may refer to a "buttstock side" which, in context, refers to the side of the device that is designed to be connected to the buffer tube and buttstock.

Figure 1B:
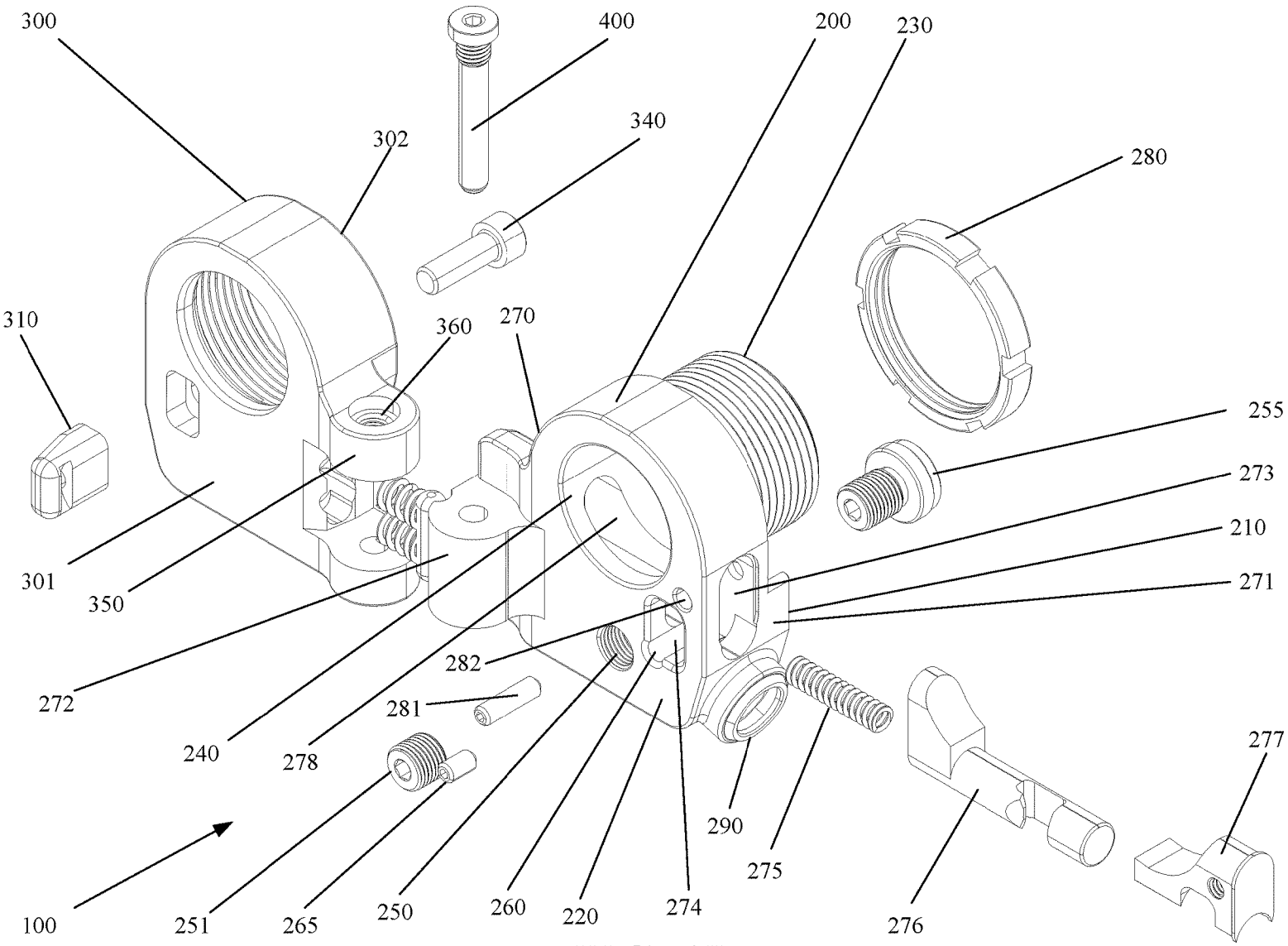
FIG. 1B is an assembly view of a folding stock adapter according to an exemplary embodiment of the invention.

FIG. 1A is an isometric view of a folding stock adapter according to an exemplary embodiment of the invention and FIG. 1B is an assembly view of a folding stock adapter according to an exemplary embodiment of the invention. As shown in FIG. 1A and FIG. 1B, a folding stock adapter 100 can have a fixed hinge portion 200 and a swinging hinge portion 300 connected by hinge pin 400.

The fixed hinge portion 200 can have a receiver side 210, an interface side 220, first lateral side 270, a second lateral side 271, a threaded protrusion 230, and a castle nut 280. A buffer hole 240 can extend from interface side 220 through the threaded protrusion 230 to the receiver side 210. The buffer hole 240 can have a cutout 278. The fixed hinge portion 200 can have a tube lock hole 250, a takedown spring hole 260, a gate hole 273, and a bolt hole 274. The fixed hinge portion 200 can have a lock screw 251, a threaded plug 255, and a set screw 265. The fixed hinge portion 200 can have a hinge pivot 272, gate 276, a gate stop 277, and a gate spring 275.

The swinging hinge portion 300 can have an interface side 301, a buttstock side 302, a buffer hole 303, a threaded portion 304, a buffer stop 305 and hinge pivot 350. The interface side 301 can have bolt 310 and screw 340. A hinge pin 400 can connect the swinging hinge portion 300 to the fixed hinge portion 200.

The threaded protrusion 230 can be sized in approximate proportions to be threadably received in a receiver of a rifle (not shown). When the fixed hinge portion 200 is attached to a receiver via the threaded protrusion 230, the castle nut 280 can be threadably rotated about the threaded protrusion 230 until the castle nut 280 presses into the receiver thereby securing and stabilizing the fixed hinge portion 200 with respect to the receiver.

Embodiments of the invention preferably omit a mil spec tube lock in favor of threaded plug 255 and optional lock screw 251. Before attachment of the fixed hinge portion 200 to a receiver, the threaded plug 255 can be fully recessed in the tube lock hole 250. Once the fixed hinge portion 200 is attached to a receiver, a head of the threaded plug 255 can be accessed through the tube lock hole 250. The threaded plug 255 can be threadably adjusted away from the receiver side 210 of fixed hinge portion 200 and towards the receiver. The receiver can have hole corresponding in size and position to the threaded plug 250 such that the threaded plug 255 can be inserted into the receiver and rotationally constrains the fixed hinge portion 200 with respect to the receiver. After adjustment of the threaded plug 255, the lock screw 251 can be threadably inserted into the tube lock hole 250 until it presses against a head of the threaded plug 255 thereby thread-locking the threaded plug 255 and lock screw 251. Thread compound can be applied to threads to further secure threaded components. Tube lock hole 250 can have a smaller diameter than buffer hole 240 and a larger diameter than takedown spring hole 260.

Hinge pivot 272 can be disposed on a first lateral side 270 of the fixed hinge portion 200 and gate hole 273 can be disposed on a second lateral side 271 of the fixed hinge portion 200. The first lateral side 270 can be on an opposite side of the fixed hinge portion 200 from the second lateral side 271. Positioning the gate hole 273 on an opposite side from the hinge pivot 272 ensures that the first lateral side 270 with the hinge pivot 272 is not unnecessarily weakened. When the folding stock adapter 100 is in an open position (as shown in FIG. 1A), ordinary carrying and transport of the rifle can cause forces to be exerted on the buttstock and, in turn, the hinge pivot 272 and first lateral side 270. By positioning gate hole 273 on an opposite side from hinge pivot 272, structural integrity of the first lateral side 270 is maintained thereby strengthening the folding stock adapter 100 against breakage from intermittent or accidental forces exerted on the buttstock when the folding stock adapter 100 is in the open position.

Gate hole 273 can have an opening on the second lateral side 271 and intersect bolt hole 274 and buffer hole 240. The intersection of buffer hole 240 and gate hole 273 can form cutout 278. Gate 276 can be sized in relative proportion to be slidably received in gate hole 273. Spring 275 can be disposed in gate hole 273 and bias the gate 276 away from the fixed hinge portion 210 and out of the gate hole 273. Gate stop 277 can be inserted in gate hole 273 after spring 275 and gate 276. Screw 281 can be threadably inserted in hole 282 to secure the gate stop 277 in the gate hole 273 thereby slidably retaining the gate 276.

Gate hole 273 can be orthogonal to hinge pin 400 in as much as gate hole 273 extends into fixed hinge portion in a first direction and the hinge pin 400 is oriented orthogonal to that first direction. In the embodiment of FIG. 1A and FIG. 1B, the gate hole 273 extends substantially horizontally and the hinge pin 400 extends substantially vertically thus the gate hole 273 and hinge pin 400 are oriented orthogonally with respect to one another.

Bolt hole 274 can be sized in approximate proportions to receive bolt 310 when the swinging hinge portion 300 is rotated about hinge pin 400 to a closed position. Bolt hole 274 can orthogonally intersect gate hole 273. As the swinging hinge portion 300 is rotated into a closed position, the bolt 310 can enter into the bolt hole 274 and lockably engage with the gate 276. The combination of gate 276 and bolt 310 together with the ancillary cooperating parts can collectively be referred to as a latch. A protruding portion of the gate 276 can form a button on the second lateral side 271. Depressing the button can slide the gate 276 deeper into the gate hole 273 and release the bolt 310 thereby allowing the folding stock adapter to be rotated from a closed position to an open position.

Takedown spring hole 260 can extend from the interface side 220 of the fixed hinge portion 200 through to the receiver side 210 of the fixed hinge portion 200. As shown in the embodiment of FIG. 1A and FIG. 1B, the takedown spring hole can partially overlap with the bolt hole 274. One of the problems of installing folding stock adapters of the related art has been to position and retain the takedown spring while simultaneously threadably attaching the folding stock adapter. Because the takedown spring is based away from the receiver and the takedown spring is normally covered by a tube lock, it can be frustrating and challenging to retain the takedown spring in the absence of a tube lock. Accordingly, embodiments of the present invention have a takedown spring hole 260 that is sized in approximate proportions to receive a takedown spring and positioned in approximate location to align with a corresponding hole on the receiver. Then, after installation of the folding stock adapter, the takedown spring and takedown pin can be inserted through takedown spring hole 260 into the receiver. Set screw 265 can be threadably inserted into takedown spring hole 260 to retain the takedown spring and takedown pin in the receiver. In embodiments of the invention, the buffer hole 240 is larger than the tube lock hole 250 which is in turn larger than the takedown spring hole 260.

Folding stock adapter 100 can have one or more sling mounts 290. Sling mount 290 can be threadably connected to either of the fixed hinge portion 200 or the swinging hinge portion 300. Although sling mount 290 is disclosed on a bottom edge of fixed hinge portion 200, other locations and multiple sling mounts 290 are contemplated and within the scope of the invention.

Figure 2:
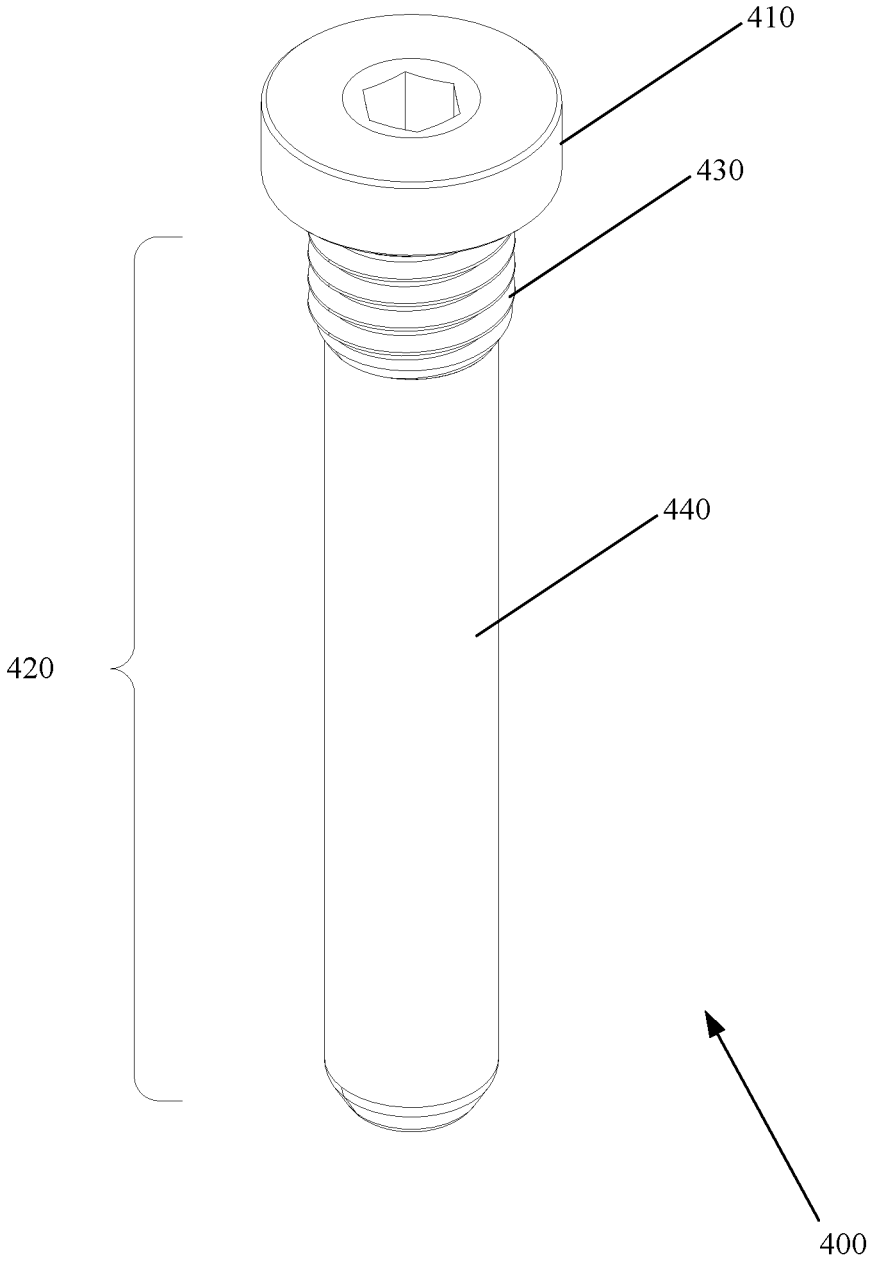
FIG. 2 is a hinge pin for a folding stock adapter according to an exemplary embodiment of the invention.

FIG. 2 is a hinge pin for a folding stock adapter according to an exemplary embodiment of the invention. As shown in FIG. 2, a hinge pin 400 has a head 410, a cylindrical body 420, a threaded portion 430, and a smooth portion 440. The hinge pin of the present invention improves on the hinge pins of the related art. In particular, hinge pins of the related art commonly included threads at an end opposite the head. The hinge pin of the related art could be secured to the hinge with a nut or a threaded recess opposite the head. The related art hinge pin, however, created a compression force on the hinge components, caused unnecessary stress on the hinge, and a pinching force on hinge components that could impede free swinging of the hinge. The hinge pin 400 of FIG. 2 resolves problems of the related art by having a threaded portion 430 of the pin 400 adjacent the head 410. The pin 400 can be inserted in a correspondingly threaded socket (e.g. FIG. 1B, 360). This design allows the force retaining the pin in the hinge to be exerted on a single part and eliminates a pinching force on the hinge components as in the related art. The side of the cylindrical body 420 opposite from the head can have a smooth portion 440 that can facilitate consistent and smooth rotation of the hinge.

Figure 3B:
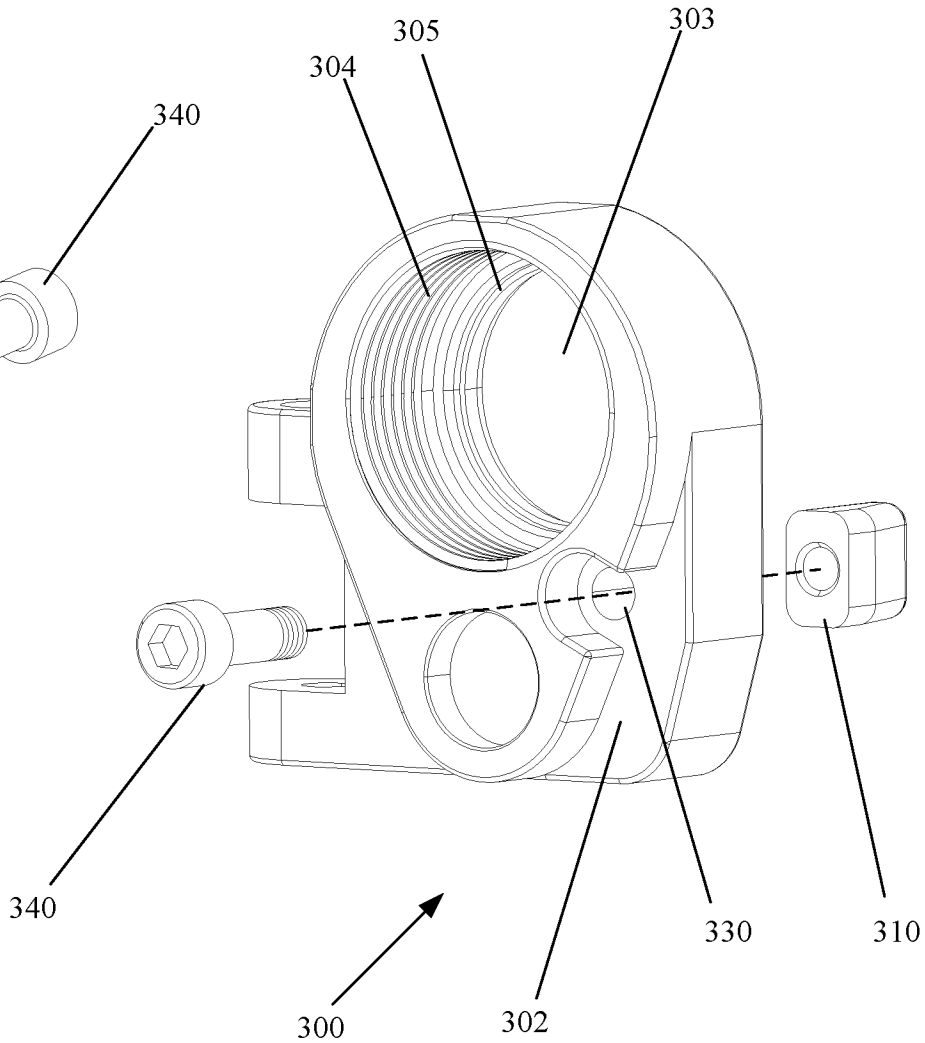
FIG. 3B is an isometric view of a buttstock side of a swinging hinge portion of a folding stock adapter according to an exemplary embodiment of the invention
Figure 3A:
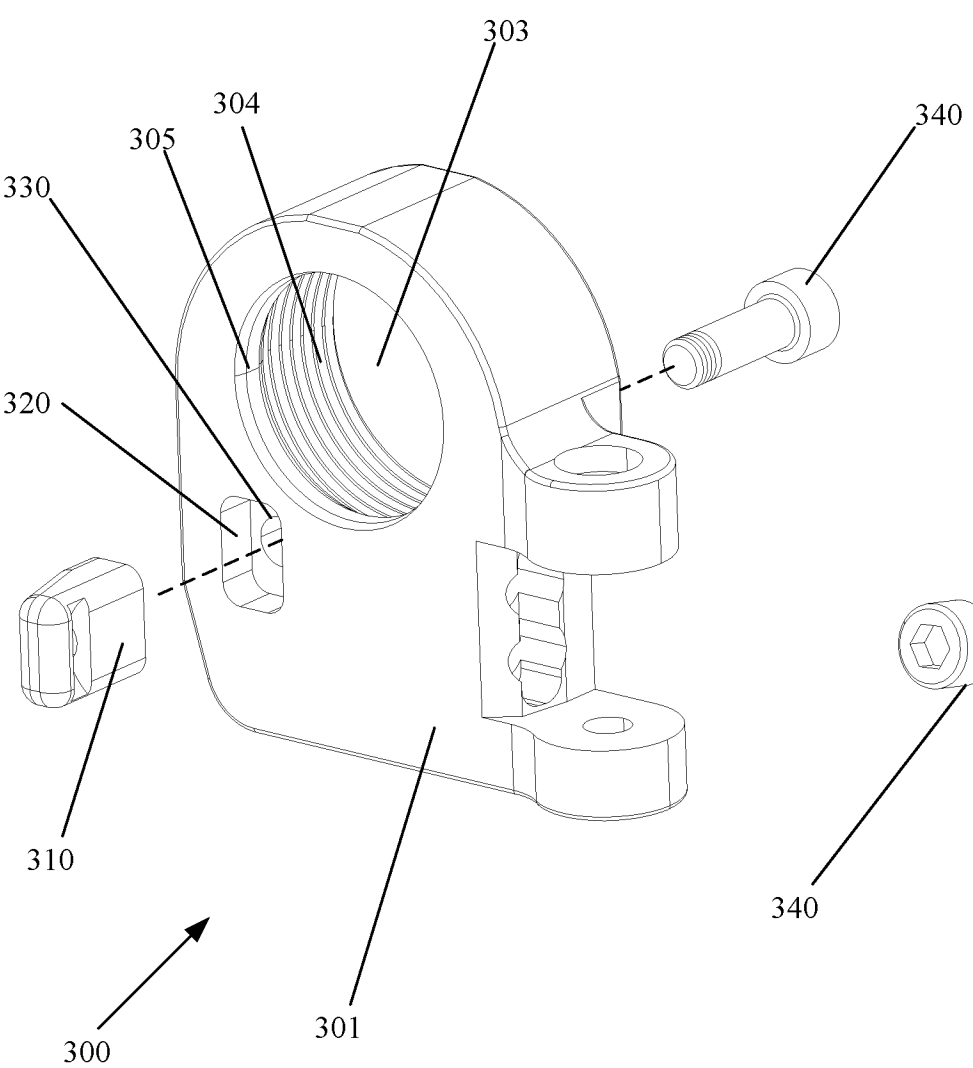
FIG. 3A is an isometric view of an interface side of a swinging hinge portion of a folding stock adapter according to an exemplary embodiment of the invention.

FIG. 3A is an isometric view of an interface side of a swinging hinge portion of a folding stock adapter according to an exemplary embodiment of the invention and FIG. 3B is an isometric view of a buttstock side of a swinging hinge portion of a folding stock adapter according to an exemplary embodiment of the invention. As shown in FIG. 3A and FIG. 3B, a swinging hinge portion 300 can have an interface side 301, a buttstock side 302, a buffer hole 303, a threaded portion 304, and a buffer stop 305. The interface side 301 can have bolt 310 and recess 320. A hole 330 can extend from inside the recess 320 though the swinging hinge portion 300 to the butt stock side 302. Screw 340 can be threadably connected to the bolt 310 through hole 330.

Threaded portion 304 of buffer hole 303 can threadably receive a buffer tube (not shown). When threaded into the threaded portion 304 of the buffer hole, the buffer stop 305 can define a point of maximum insertion of the buffer tube. Additionally, buffer stop 305 can narrow the buffer hole 303 to a sufficient degree to retain a buffer (not shown) within the buffer tube (not shown).

Bolt 310 is preferably non-cylindrical and sized in appropriate proportions to be received in correspondingly shaped bolt hole 320. Bolt 310 can be retained in bolt hole 320 with screw 340. Bolt 310 is preferably separately formed from the main body of the swinging hinge portion 300 whereas bolts of the related art have been integrally formed. The main body of the swinging hinge portion 300 and the bolt 310 can preferably be formed from different materials. For example, the main body of the swinging hinge portion 300 can be formed from lightweight aluminum while bolt 310 can be formed from a harder substance such as steel. This allows the folding hinge adapter to be both lightweight where strength is less important and stronger but heavier where extra strength is important. In the folding stock adapter, much force can be exerted on the bolt 310 because it is a small component that bears most of the force to maintain the folding stock adapter in a closed position. Accordingly, preferred embodiments of the invention use a strong material for the bolt 310 but may use a lighter weight material such as aluminum for the main body.

Bolt 310 is preferably not round and disposed in recess 320 so that it cannot rotate during assembly or use. Additionally, recess 320 allows the body of bolt 310 to longer thereby providing a deeper and more threads for attachment of screw 340. Bolt 310 can be sized in approximate proportions to be received in bolt hole (FIG. 1A, 274) of the fixed hinge portion.

Figure 4A:
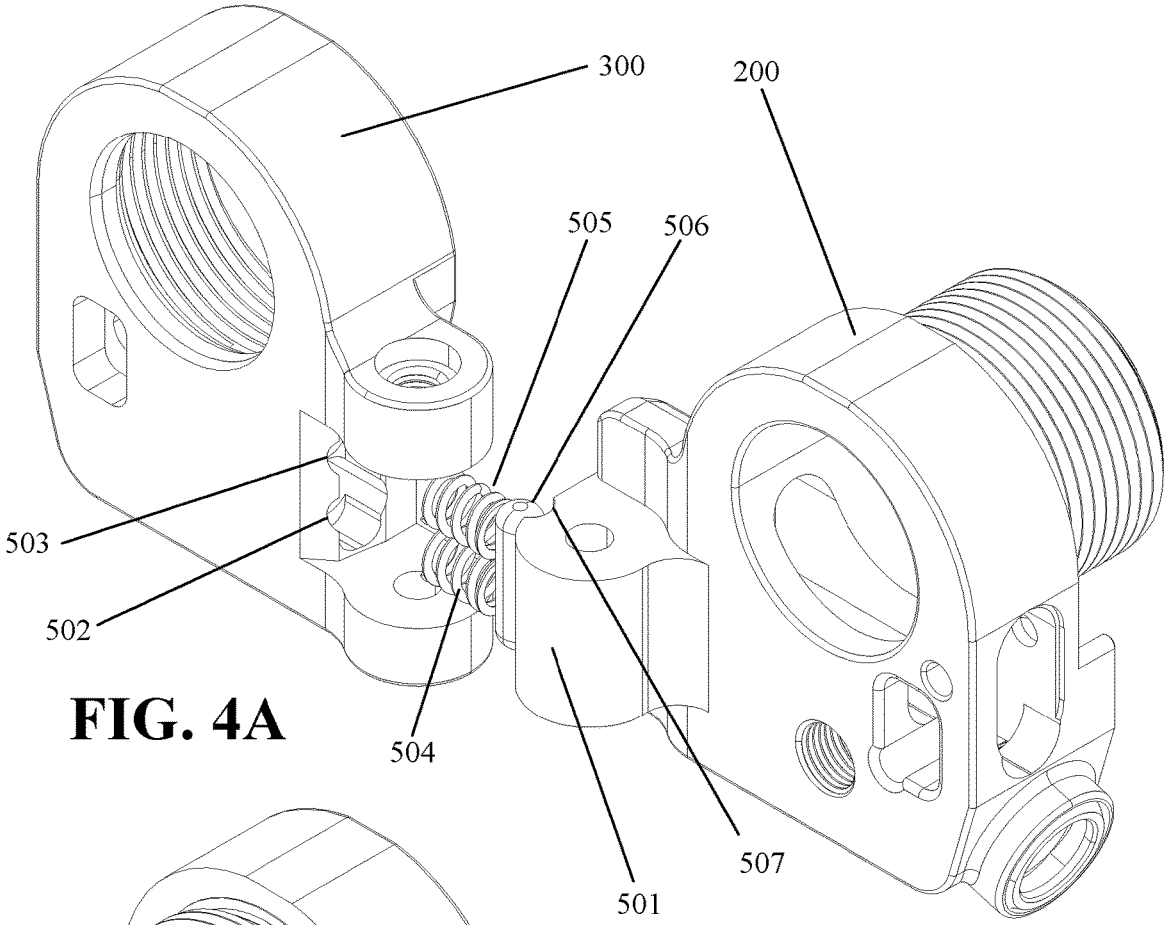
FIG. 4A is an assembly view of an interface side of a pivot portion of a folding stock adapter according to an exemplary embodiment of the invention.
Figure 4B:
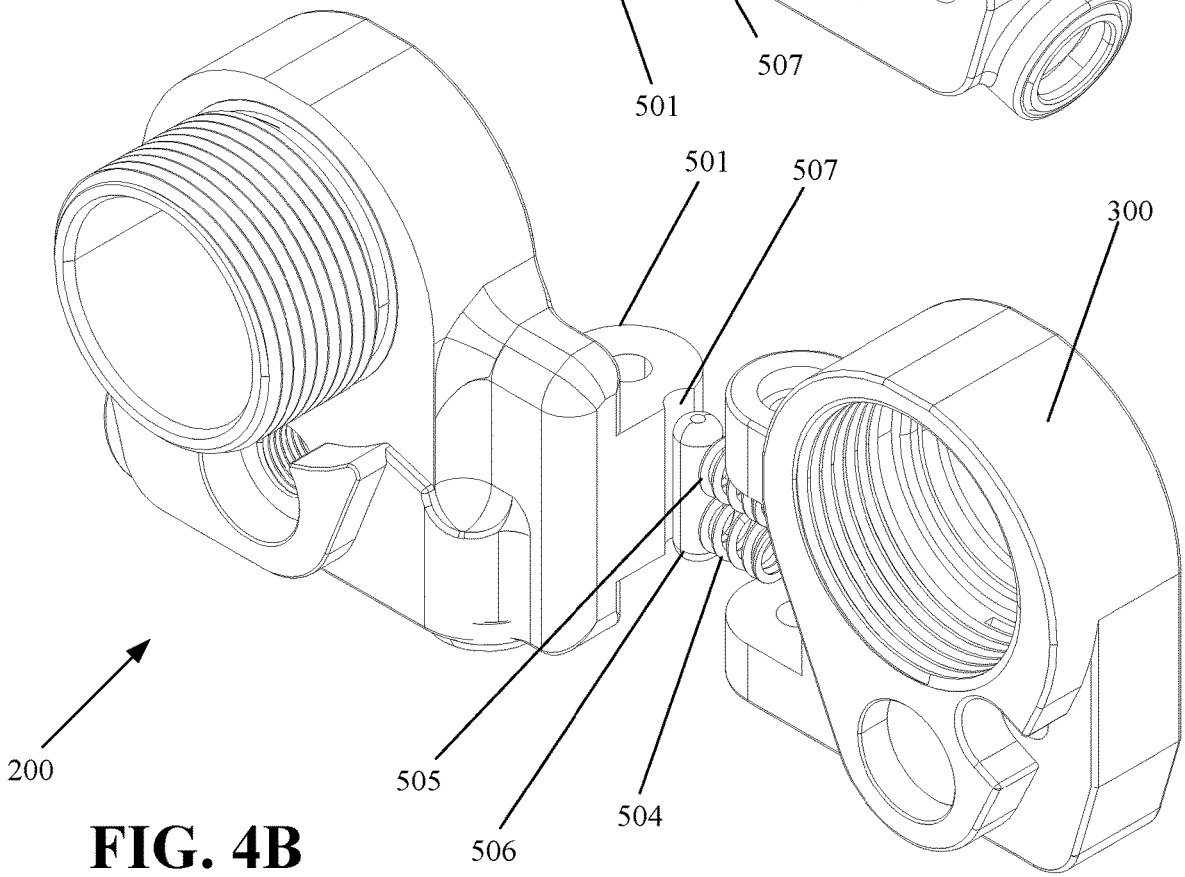
FIG. 4B is an assembly view of a pivot portion of a folding stock adapter according to an exemplary embodiment of the invention.

FIG. 4A is an assembly view of an interface side of a pivot portion of a folding stock adapter according to an exemplary embodiment of the invention and FIG. 4B is an assembly view of a pivot portion of a folding stock adapter according to an exemplary embodiment of the invention. As shown in FIG. 4A and FIG. 4B, fixed hinge portion 200 and swinging hinge portion 300 can include a snap-lock mechanism near their connection at the hinge. Swinging hinge portion can have holes 502 and 503 and springs 504 and 505. Springs can 504 and 505 can be sized in relative proportions to be received in holes 502 and 503. Roller 506 can be disposed on top of springs 504 and 505 and compress springs 504 and 505 into holes 502 and 503 when fixed hinge portion 200 is connected to swinging hinge portion 300 as shown in FIG. 1A. When the folding stock adapter is rotated into an open position, roller 506 can snap into detent 507 thereby releasably retaining the folding stock adapter in the open position. When the folding stock adapter is rotated from the open position to a closed position, the roller 506 can roll up the sides of detent 507, thereby compressing the spring and, thereafter, the roller can roll across bearing surface 501. The combination of roller 506, detent 507, and springs 504 and 505 can contribute to smooth hinging of the folding stock adapter between an open and closed position. The shape of the roller 506 and bearing surface 501 provide particular benefits to this invention. By way of comparison, related art devices have used spherical ball bearings in the hinge area rather than a cylindrical roller such as roller 506. Where the main body of the folding stock adapter is formed from a soft material such as aluminum, steel ball bearings can wear a track into the bearing surface through repeated use. By instead using a cylindrical roller such as roller 506, the contact area between the roller 506 and the bearing surface 501 is increased as comparted to a ball bearing thereby reducing wear on the bearing surface 501 and increasing the longevity and quality feel of the folding stock adapter.

Figure 5A:
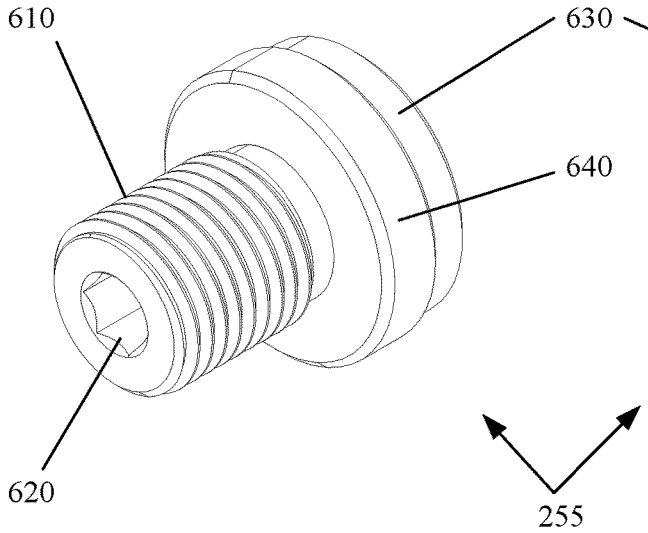
FIGS. 5A and 5B are isometric views of a threaded plug according to an exemplary embodiment of the invention.
Figure 5B:
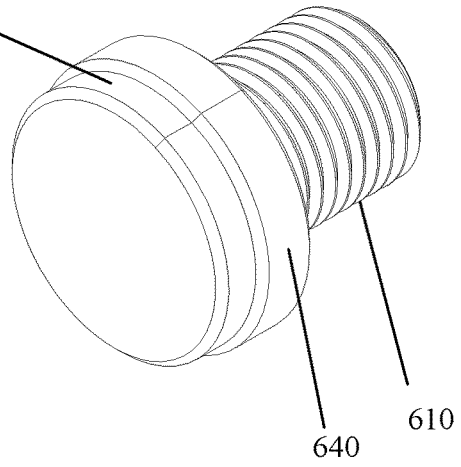
Figure 5C:
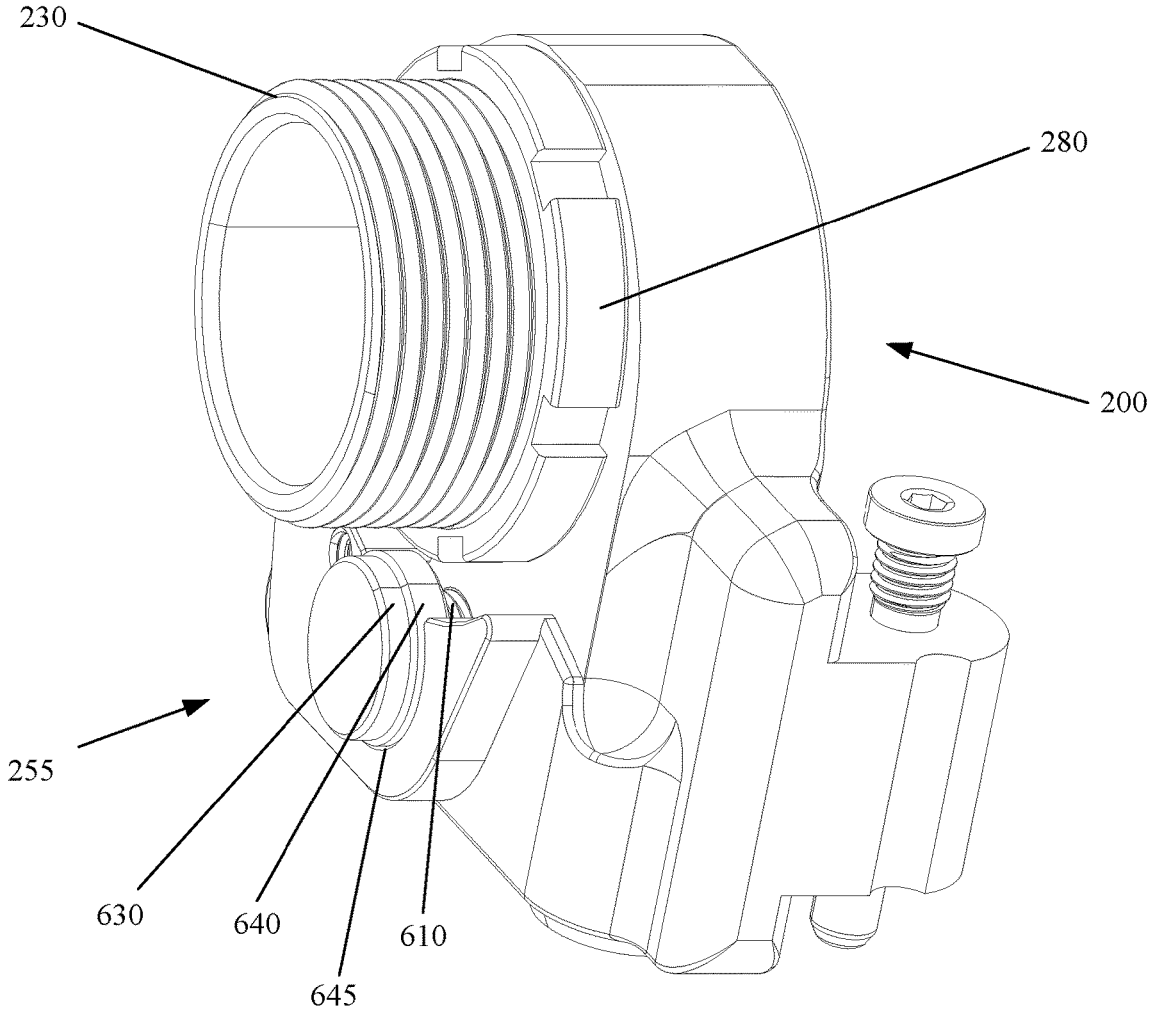
FIG. 5C is a view of a threaded plug and a fixed hinge portion of a folding stock adapter according to an exemplary embodiment of the invention.

FIGS. 5A and 5B are isometric views of a threaded plug according to an exemplary embodiment of the invention. FIG. 5C is a view of a threaded plug and a fixed hinge portion of a folding stock adapter according to an exemplary embodiment of the invention. As shown in FIG. 5A, FIG. 5B, and FIG. 5C, a threaded plug 255 can include a head 630, a shoulder 640, a threaded shaft 610, and a tool receiving portion 620. The head 630 can be sized in approximate proportions to be received in a corresponding recess of a rifle receiver. The shoulder 640 can be sized in relative proportions to be received in a recess 645 of the fixed hinge portion 200. The threaded shaft 610 can be sized in approximate proportions to be threadably received in the tube lock hole (FIG. 1B, 250). Before installation of the folding stock adapter to a rifle, the threaded plug 255 can be threadably installed into the tube lock hole (FIG. 1B, 250) from the receiver side of the fixed hinge portion. The threaded plug 255 is preferably fully inserted into the tube lock hole such that the shoulder 640 and most of the head 630 is within recess 645. The folding stock adapter can be installed to a rifle by threadably inserting the threaded protrusion 230 into a rifle receiver. When the folding stock adapter is fully threadably inserted, castle nut 280 can be tightened to thread lock the threaded protrusion to the receiver. To further secure the folding stock adapter to the rifle, the tool receiving portion 620 of the threaded plug 255 can be access through tube lock hole 250. The threaded plug 255 can be rotated to extend the head 630 of the threaded plug 255 away from the receiver side of the fixed hinge portion and into a corresponding recess on the rifle receiver. This additional connection point can prevent unintended rotation of the folding stock adapter with respect to the rifle receiver. After the threaded plug 255 is fully extended into the corresponding recess of the rifle receiver, lock screw (FIG. 1B, 251) can be threaded into tube lock hole (FIG. 1B, 255) until it presses on threaded plug 255 thereby thread locking threaded plug 255 and lock screw (FIG. 1B, 251).

Preferred embodiments of the invention have a threaded plug 255 having a shoulder 640 that is a larger diameter than a head 630 of the threaded plug 255. A larger shoulder 640 creates a larger bearing surface between shoulder 640 and recess 645 and is desirable for durability and resilience. The relative size of shoulder to head, however, is not critical and shoulders and heads of varying sizes and identical sizes are contemplated and within the scope of the invention.

Figure 6A:
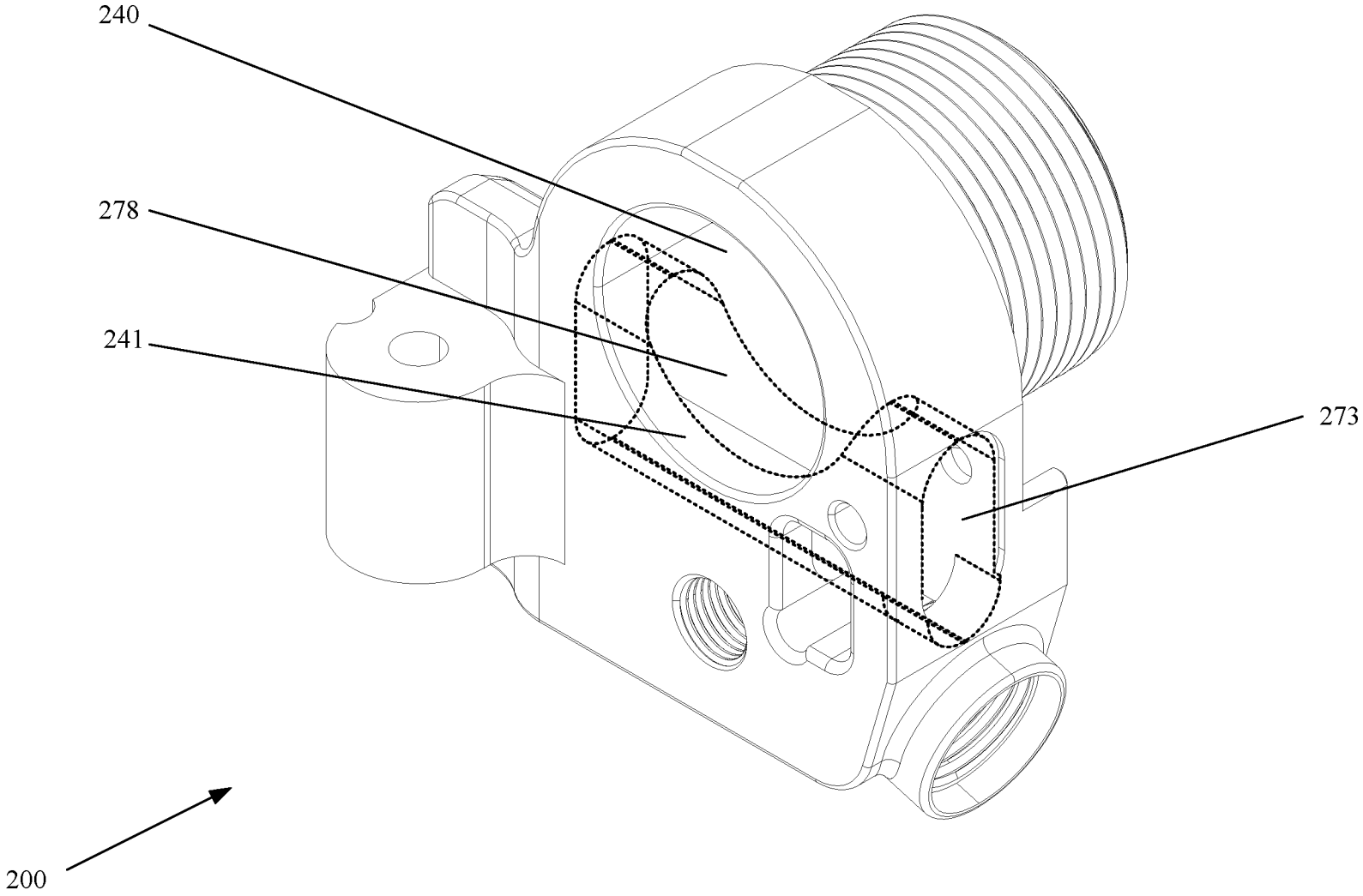
FIG. 6A is a isometric view of a gate hole of a folding stock adapter according to an exemplary embodiment of the invention.
Figure 6B:
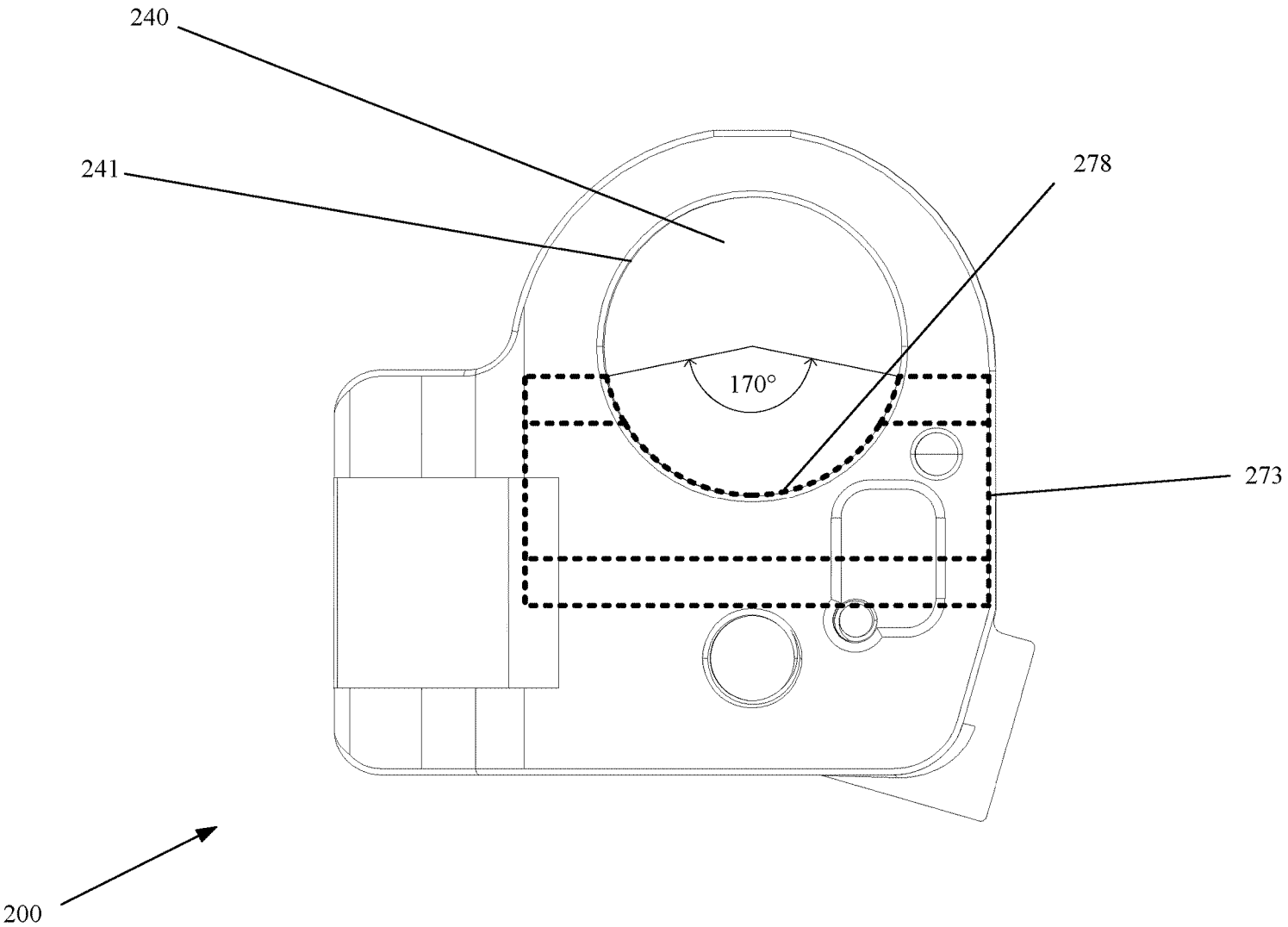
FIG. 6B is a front view of a gate hole of a folding stock adapter according to an exemplary embodiment of the invention.

FIG. 6A is an isometric view of a gate hole of a folding stock adapter according to an exemplary embodiment of the invention and FIG. 6B is a front view of a gate hole of a folding stock adapter according to an exemplary embodiment of the invention. As shown in FIG. 6A and FIG. 6B, a fixed hinge portion 200 can have a gate hole 273 (shown in dotted line for clarity). Gate hole 273 can orthogonally intersect buffer hole 240 forming cutout 278 on an inner permitter 241 of buffer hole 240. The cutout 278 can permit a portion of the gate to protrude into the buffer hole 240 and selectively retain the bolt carrier group extender (see discussion in conjunction with FIG. 8A and FIG. 8B)

The opening for the gate hole 273 is preferably on an opposite side from hinge pivot (FIG. 1A, 272). This prevents unnecessary weakening of the hinge mount by gate hole 273 and also permits the gate hole 273 to be larger than if it was disposed on the hinge mount side. A large gate hole 273 facilitates easy installation of latch components.

The cutout 278 on the inner perimeter 241 of buffer hole 240 is preferably disposed slightly below the center of fixed hinge portion 200. If the inner perimeter 241 is considered a circle of 360 degrees, the cutout 278 can extend slightly less than 180 degrees of the perimeter. In some preferred embodiments the cutout is approximately 170 degrees. In other embodiments a bolt carrier group catch of the gate can be proximate the opening of the gate hole 273. The cutout 278 can be at least 90 degrees of the perimeter 241.

Figure 7B:
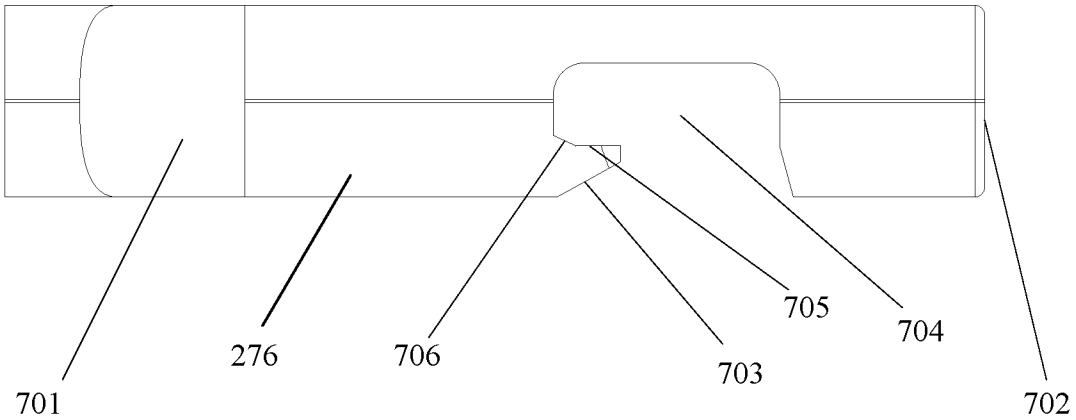
FIG. 7B is a top view of a gate of a folding stock adapter according to an exemplary embodiment of the invention.
Figure 7A:
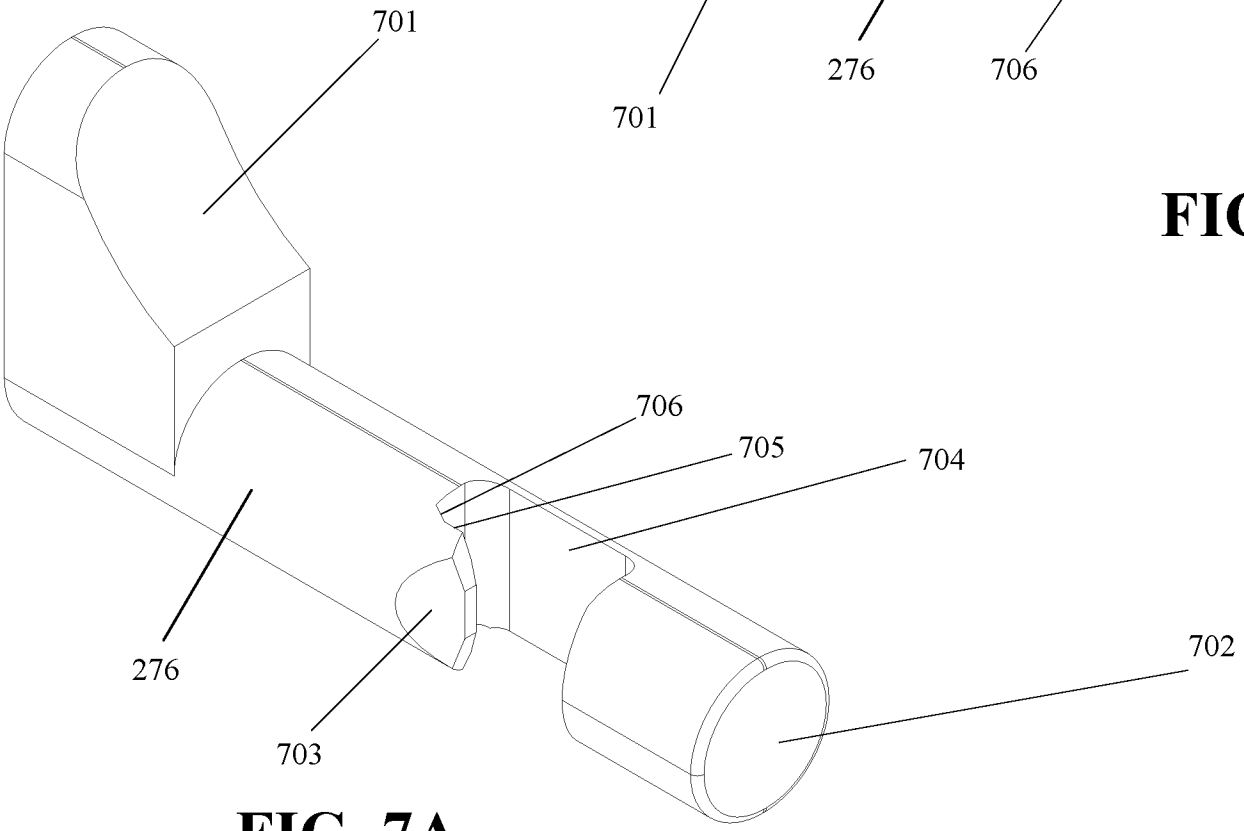
FIG. 7A is an isometric view of a gate of a folding stock adapter according to an exemplary embodiment of the invention.

FIG. 7A is an isometric view of a gate of a folding stock adapter according to an exemplary embodiment of the invention and FIG. 7B is a top view of a gate of a folding stock adapter according to an exemplary embodiment of the invention. As shown in FIG. 7A and FIG. 7B, a gate 276 can have a bolt carrier group (BCG) catch 701, a button end 702, a beveled lip 703, a mouth 704, a catch 705, and a beveled throat 706. The gate 276 can be sized in relative proportions to cooperate with and selectively retain bolt (FIG. 1A, 310).

Figure 8B:
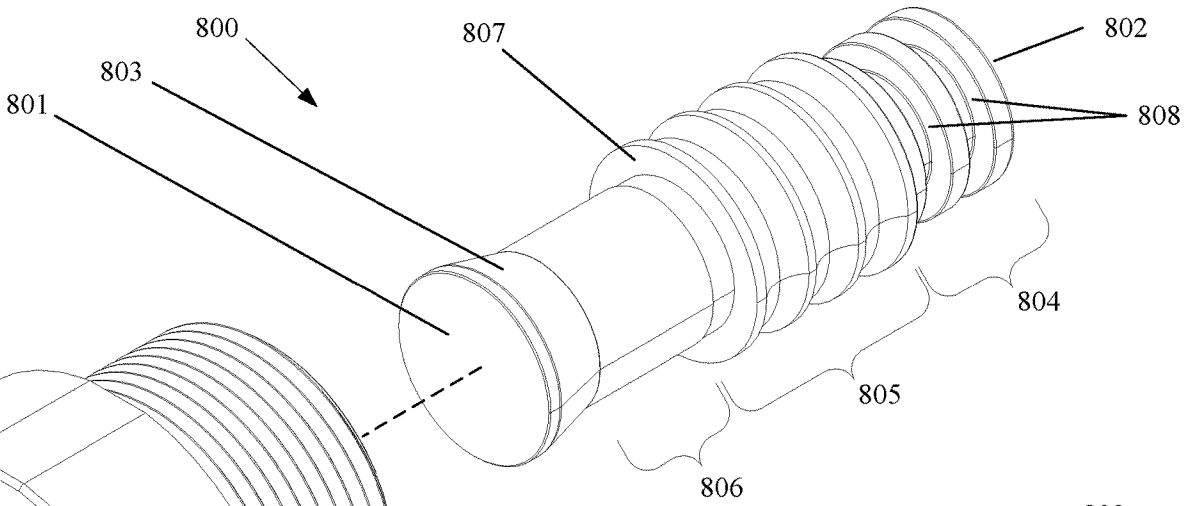
FIG. 8B is an isometric view of a bolt carrier group extender and a receiver side portion of a folding stock adapter according to an exemplary embodiment of the invention.
Figure 8B:
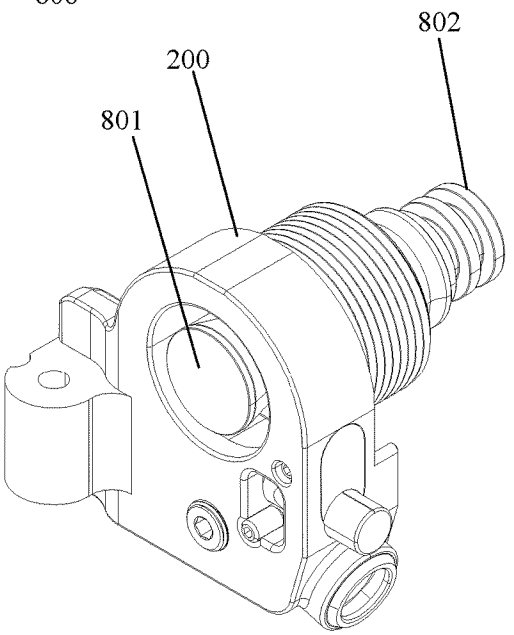
Figure 8A:
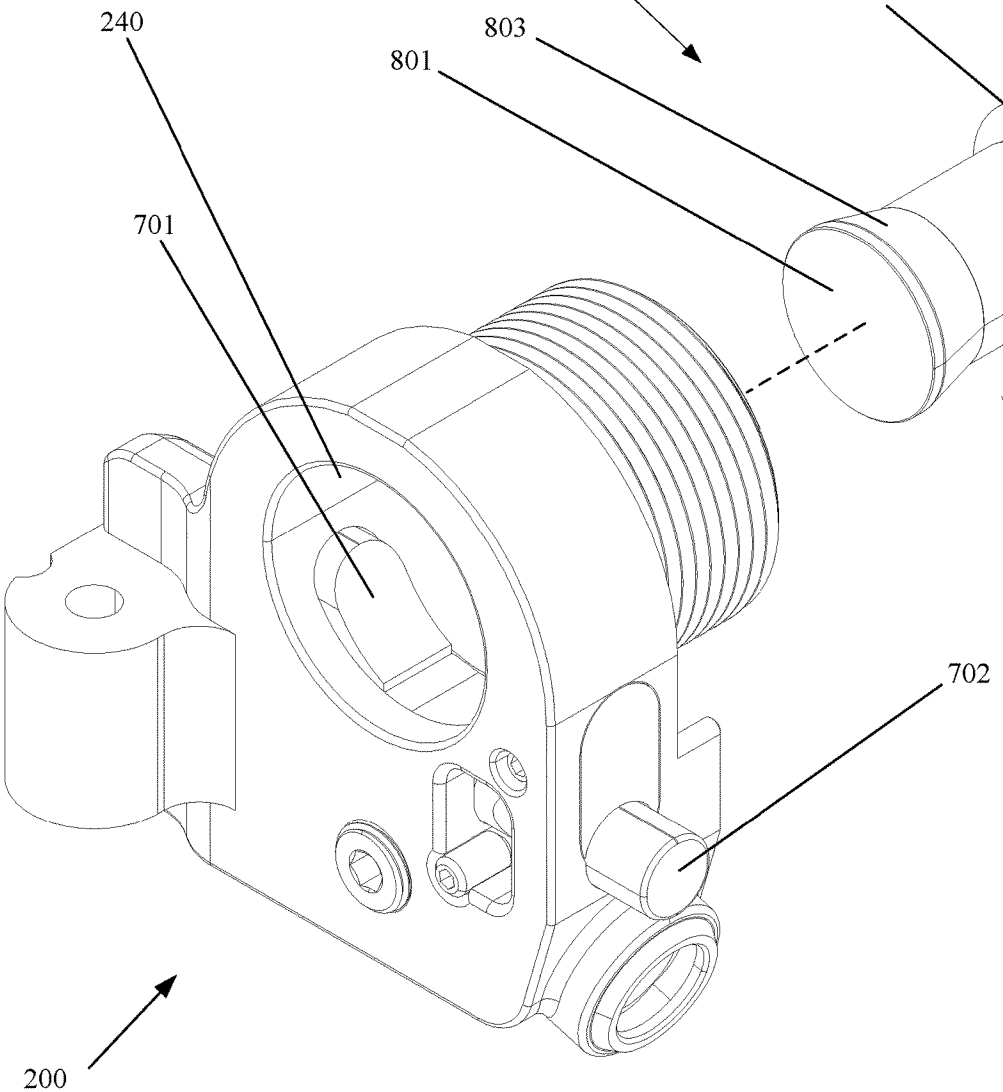
FIG. 8A is an assembly view of a bolt carrier group extender and a receiver side portion of a folding stock adapter according to an exemplary embodiment of the invention.

The BCG catch 701 can cooperate with and selectively retain BCG extender as will be more particularly described in conjunction with FIG. 8A and FIG. 8B. Button end 702 of gate 276 can protrude from the fixed hinge portion of the folding stock adapter and present an interface for a user to press on the gate 276, sliding it deeper into the gate hole thereby releasing the bolt from catch and allowing the folding stock adapter to open. Beveled lip 703 can be sloped such that when closing the folding stock adapter, a head of the bolt is pressed against the beveled lip 703 thereby imparting a lateral force on the gate 276 and urging the gate 276 to the side against spring pressure so that the bolt can enter the mouth 704. Once fully in mouth 704, the catch 705 can slide into a notch on the bolt and retain the bolt and the swinging hinge portion in a closed position. One of the many novel aspects of embodiments of the invention include a beveled throat 706 and is an improvement over the related art. Related art folding stock adapters do not have a beveled throat 706. Spring bias on the gate 276 press the catch 705 and beveled throat 706 into a corresponding notch on the bolt. The beveled throat 706 creates a wedge that takes up slack and offsets any imprecision in the fitting between catch 705 and the bolt. Whereas gates and bolts of the prior art were prone to loose fitment and jiggling, the gate disclosed herein includes a beveled throat 706 that has a wedge fit with the bolt and resolves the problem of loose fitment and jiggling.

FIG. 8A and FIG. 8B are assembly views of a bolt carrier group extender and a receiver side portion of a folding stock adapter according to an exemplary embodiment of the invention. As shown in FIG. 8A and FIG. 8B, a BCG extender 800 can be selectively retained in buffer hole 240 of fixed hinge portion 200. The BCG extender 800 can have a buffer side 801, BCG side 802, taper 803, insertion portion 804, wide portion 805, narrow portion 806, stop 807, and recesses 808.

Generally, the BCG extender 800 can be sized in relative proportions to slide through buffer hole 240 when the folding stock adapter is in the closed position, but retained by the BCG catch 701 of the gate when in the open position. The buffer side 801 BCG extender 800 can be flat and sized in approximate proportions as a rear of the BCG such that the buffer side 801 can interface with a buffer in much the same way as the BCG normally would. Taper 803 can define a transition area between buffer side 801 and narrow portion 806 to receive and evenly distribute force from buffer side 801 to narrow portion 806 of BCG extender 800.

Figures 11A, 11B:
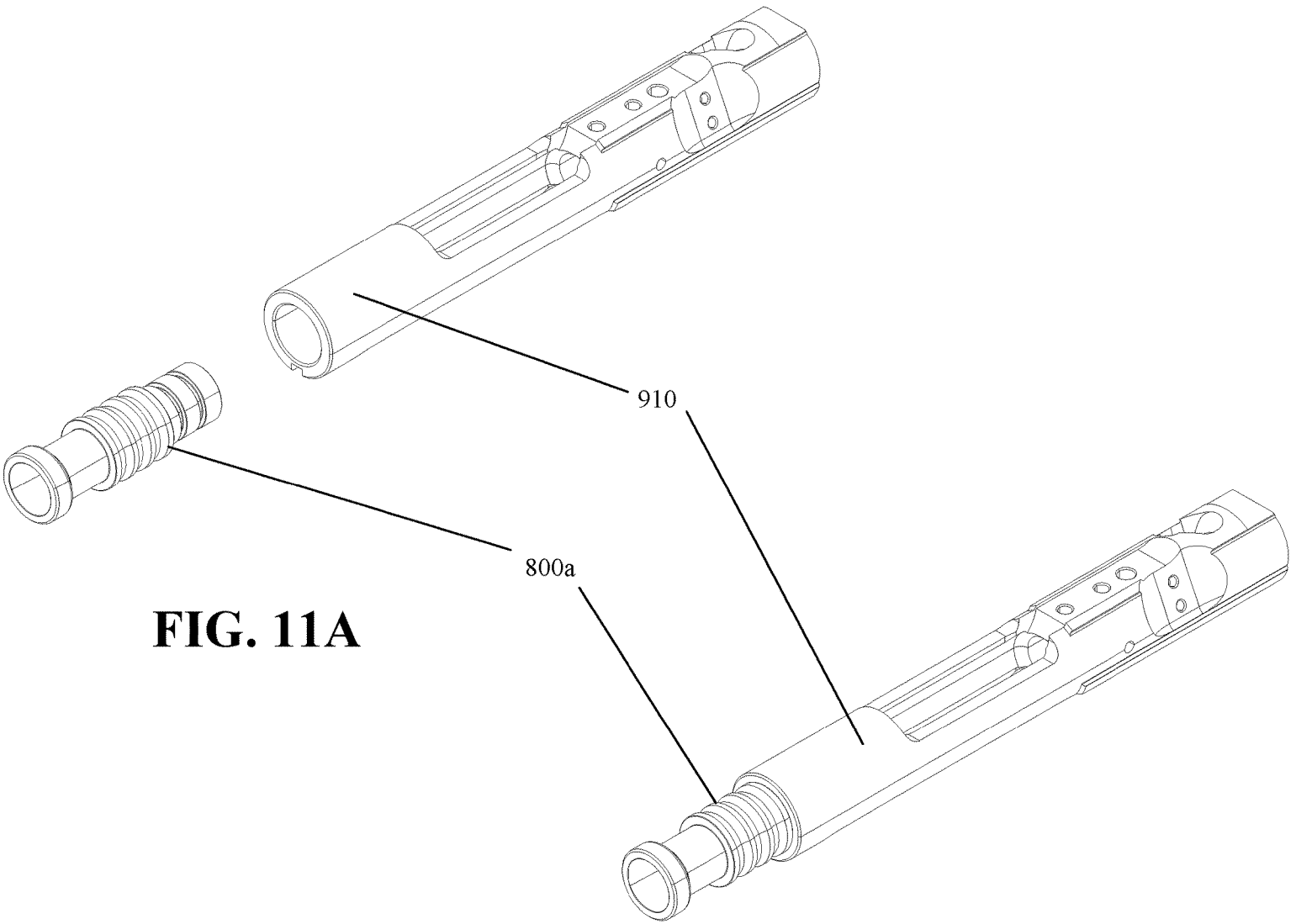
FIG. 11A and FIG. 11B are views of bolt carrier group extension and a bolt carrier group according to an exemplary embodiment of the invention.

BCG side 802 and insertion portion 804 of BCG extender 800 can be sized in approximate proportions to be received into a similarly sized hole in a mil spec BCG (see e.g., FIG. 11A). Insertion portion 804 can have recesses 808. Recesses 808 can receive o-rings (not shown) that generate a friction force to retain the BCG extender 800 in a BCG. Wide portion 805 of BCG extender 800 can have a scalloped profile to reduce weight and increase rigidity. Narrow portion 806 of BCG extender 800 can receive BCG catch 701. When the folding stock adapter is in the open position, spring bias on the gate can push the BCG catch 701 into the buffer hole 240 such that BCG catch 701 touches or nearly touches narrow portion 806 of BCG extender 800 thereby retaining BCG extender 800 in buffer hole 240. In particular, in an open position, buffer stop 807 of the wide portion 805 can prevent BCG extender 800 from sliding past BCG catch 701. When the folding stock adapter is in a closed position, the bolt can press on the gate against spring bias to push BCG catch 701 away from buffer hole 240 to allow free movement of BCG extender 800.

Figure 9:
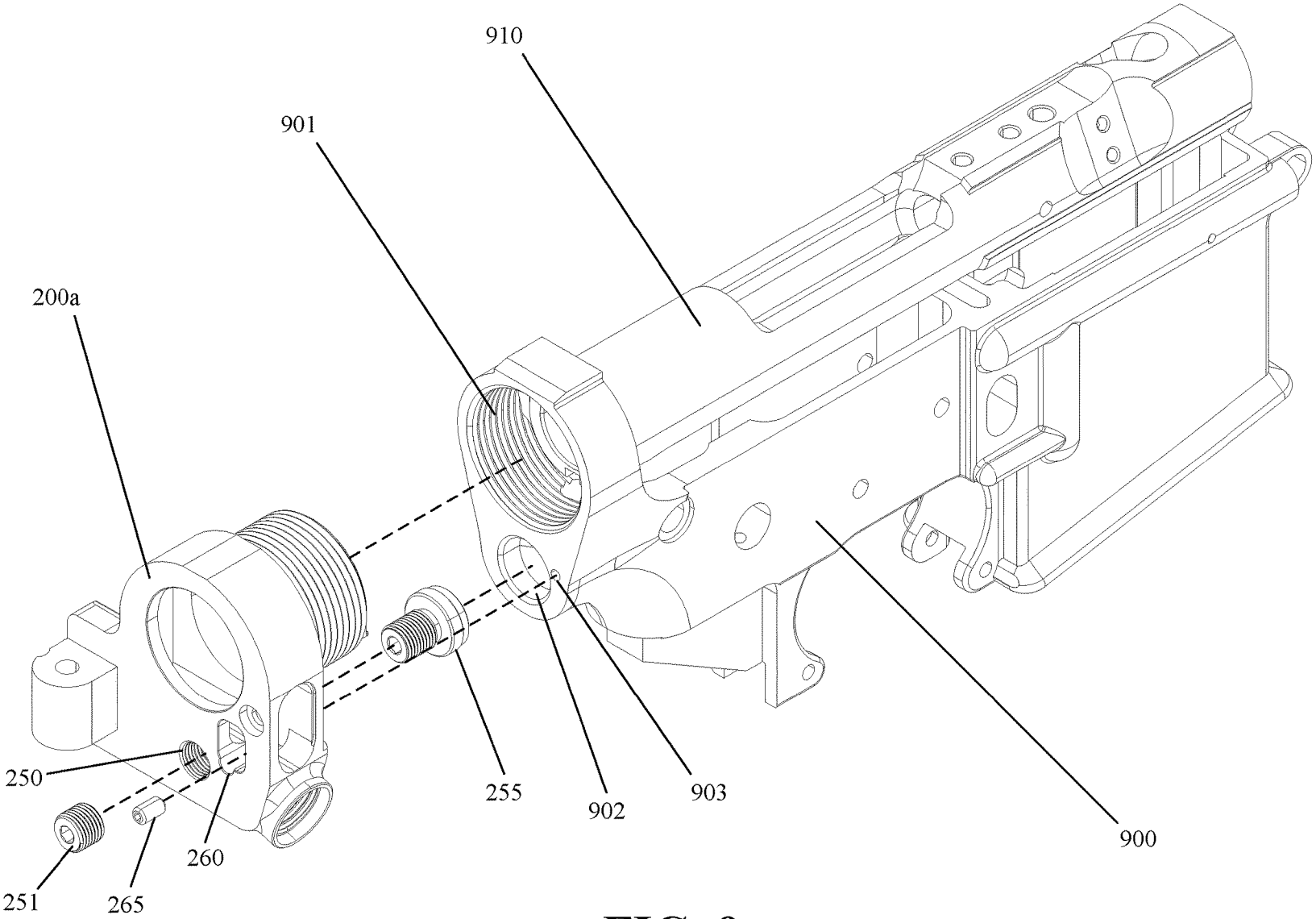
FIG. 9 is an assembly view of a fixed hinge portion of a folding stock adapter and a rifle lower according to an exemplary embodiment of the invention.

FIG. 9 is an assembly view of a fixed hinge portion of a folding stock adapter and a rifle lower according to an exemplary embodiment of the invention. As shown in FIG. 9, a fixed hinge portion 200*a* includes a tube lock hole 250, a lock screw 251, a threaded plug 255, takedown spring hole 260, and a set screw 265. A rifle receiver can have a lower 900 and BCG 910. Lower 900 can have a threaded buffer hole 901, tube lock hole 902, and take down spring hole 903.

A method of assembling the foregoing will now be disclosed. Threaded plug 255 can be fully screwed into fixed hinge portion 200*a* from the receiver side. Fixed hinge portion 200*a* can be screwed into threaded buffer hole 901 and rotationally oriented with tube lock hole 902 and takedown spring hole 903. An optional castle nut (e.g. FIG. 5C, 280) can be tightened against the receiver lower 901 to thread lock the fixed hinge portion 200*a* to the lower 901. A tool receiving portion of the threaded plug 255 can be accessed through tube lock hole 250 and threaded plug 255 can be extended from fixed hinge portion 200*a* into tube lock hole 902 of lower 900. Lock screw 251 can be threadably inserted into tube lock hole 250 and tightened against threaded plug 255 to thread lock threaded plug 255 in tube lock hole 902 of receiver 900. A takedown pin and takedown spring (not shown) can be inserted through takedown spring hole 265 of fixed hinge portion 200*a* into takedown spring hole 903 of receiver 900. Set screw 265 can be threadably inserted into takedown spring hole 265 to retain takedown pin and takedown spring (not shown) in takedown spring hole 903 of receiver 900. Both tube lock hole 250 and takedown spring hole 260 can extend from an interface side of the fixed hinge portion 200*a* through to a receiver side of the fixed hinge portion 200*a*.

Figure 10B:
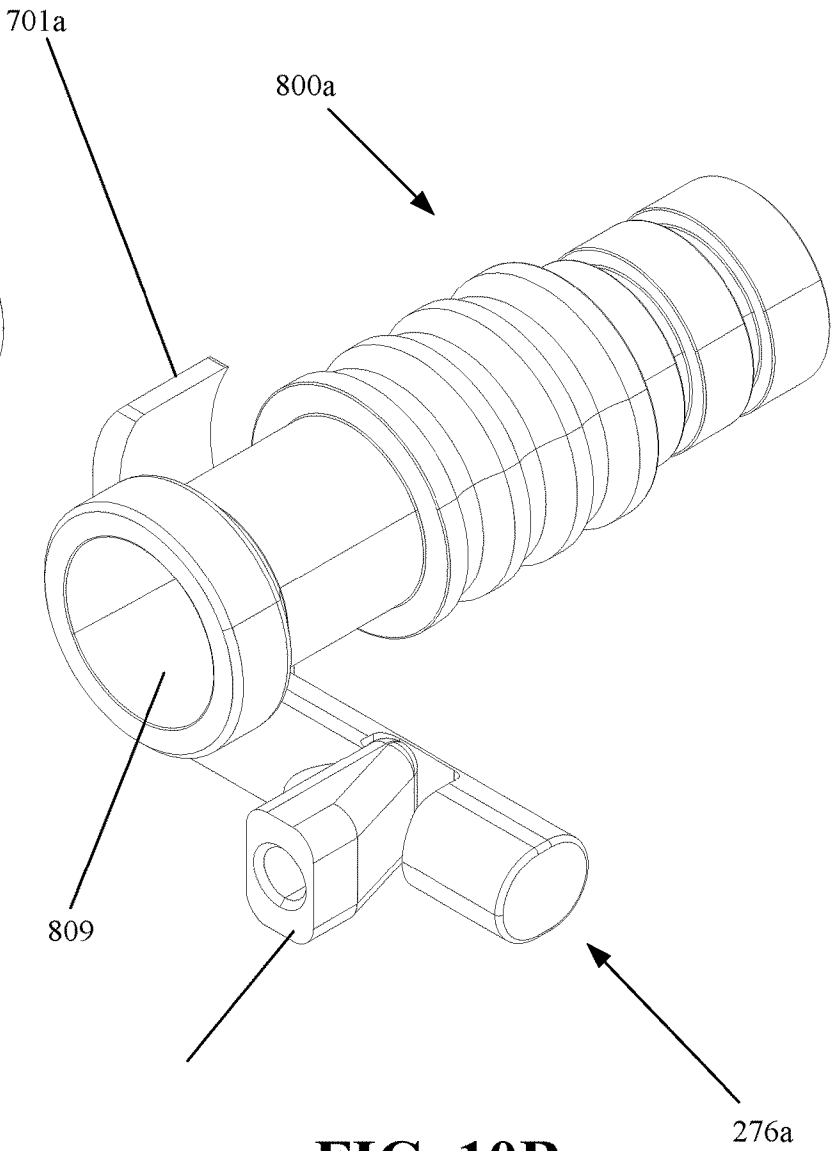
FIG. 10A and FIG. 10B are isometric views of a gate and a bolt carrier group extension according to an exemplary embodiment of the invention.
Figure 10A:
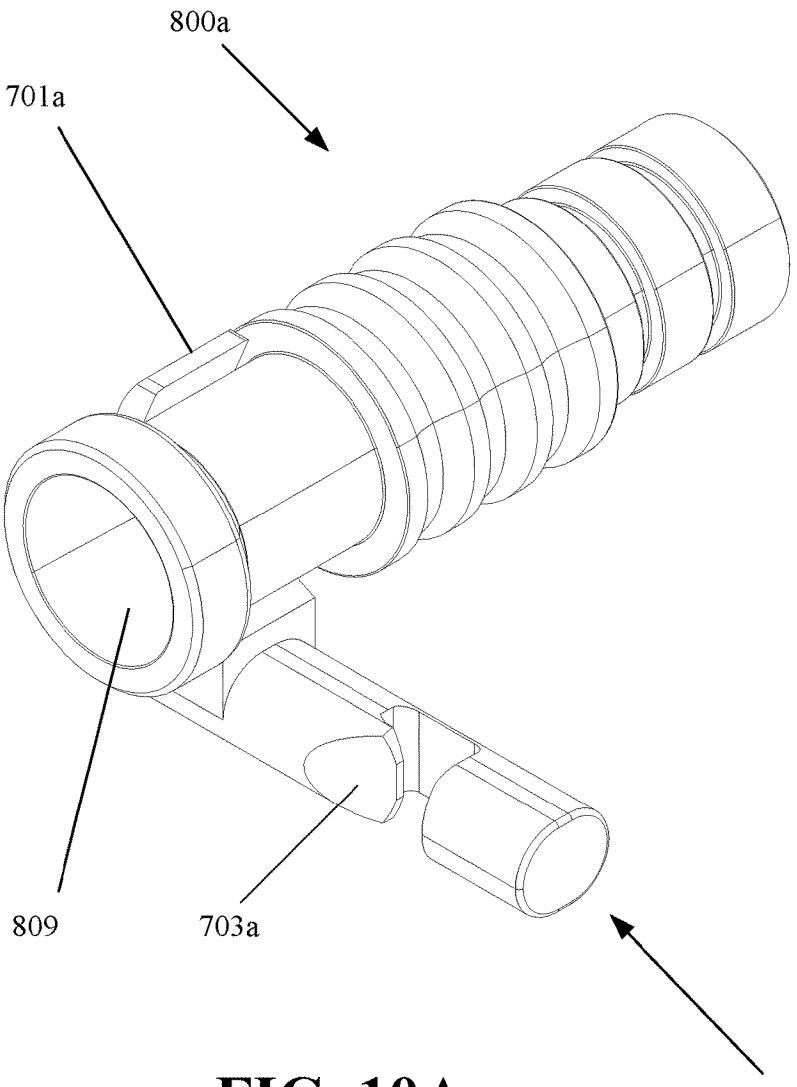

FIG. 10A and FIG. 10B are isometric views of a gate and a bolt carrier group extension according to an exemplary embodiment of the invention. As shown in FIG. 10A and FIG. 10B, BCG catch 701*a* of gate 276*a* can selectively interface with BCG extender 800*a*. In an embodiment of the invention, gate 276*a* can have a larger and taller BCG catch 701*a* than the gate 276 of FIG. 7A. BCG extender 800*a* can have longitudinal bore hole 809. Longitudinal bore hole 809 can partially or completely penetrate BCG extender 800*a* to reduce weight. The larger and taller BCG catch 701*a* can have a larger contact area with BCG extender 800*a* than BCG catch of gate 276 of FIG. 7A. In operation, a user will occasionally, on accident, fire a rifle while the folding stock adapter is in the open position. This can cause the BCG extender 800*a* to slam into the BCG catch 701*a* causing damage to both BCG catch 701*a* and BCG extender 800*a*. While robust and strong, the components of the folding stock adapter can only withstand a limited number of accidental firings in the open position before failure. A larger and taller BCG catch 701*a* can distribute the force of an accidental firing of the rifle while in the open position and extend the life of the folding stock adapter in the event of accidental misuse. In preferred embodiments of the invention, the BCG catch 701*a* can be as tall as or taller than the narrow portion of BCG extender 800*a* and a cutout formed by the intersection of a gate hole and a buffer hole (e.g. as described in conjunction with FIG. 6A and FIG. 6B) can extend more than 180 degrees of an inner perimeter of a buffer hole.

Although the other components of the folding stock adapter are not shown, the relative position of the gate 276*a* and BCG extender 800*a* in FIG. 10A can correspond to the folding stock adapter being in an open position where the BCG catch 701*a* of gate 276*a* is spring biased into BCG extender 800*a*. The relative position of the gate 276*a* and BCG extender 800*a* in FIG. 10B can correspond to the folding stock adapter being in a closed position with bolt 310 interfaced with gate 276*a*. In transitioning from an open position to a closed position, bolt 310 can be pressed against beveled lip 703*a* pushing the gate 276*a* and BCG catch 701*a* against spring bias and away from BCG extender 800*a*. In continuing to transition to the closed position, when bolt 310 slides past beveled lip 703*a*, bolt 310 can be retained in gate 276*a* while maintaining the BCG catch 701*a* in a position away from the BCG extender 800*a* as shown in FIG. 10B to allow free movement and operating of BCG extender 800*a*.

FIG. 11A and FIG. 11B are views of bolt carrier group extension and a bolt carrier group according to an exemplary embodiment of the invention. As shown in FIG. 11A and FIG. 11B, a BCG extender 800*a* can be sized in approximate proportions to be slidably received in a corresponding hole on a rear of BCG 910. Because folding stock adapter can effectively increase the length of buffer tube, the buffer spring can be out of tune for proper functioning of the rifle. The BCG extender 800*a* can effectively increase the length of the BCG 910 to account for the length added by the folding stock adapter and avoid having source a buffer and spring tuned for the increased length.

Figure 12A:
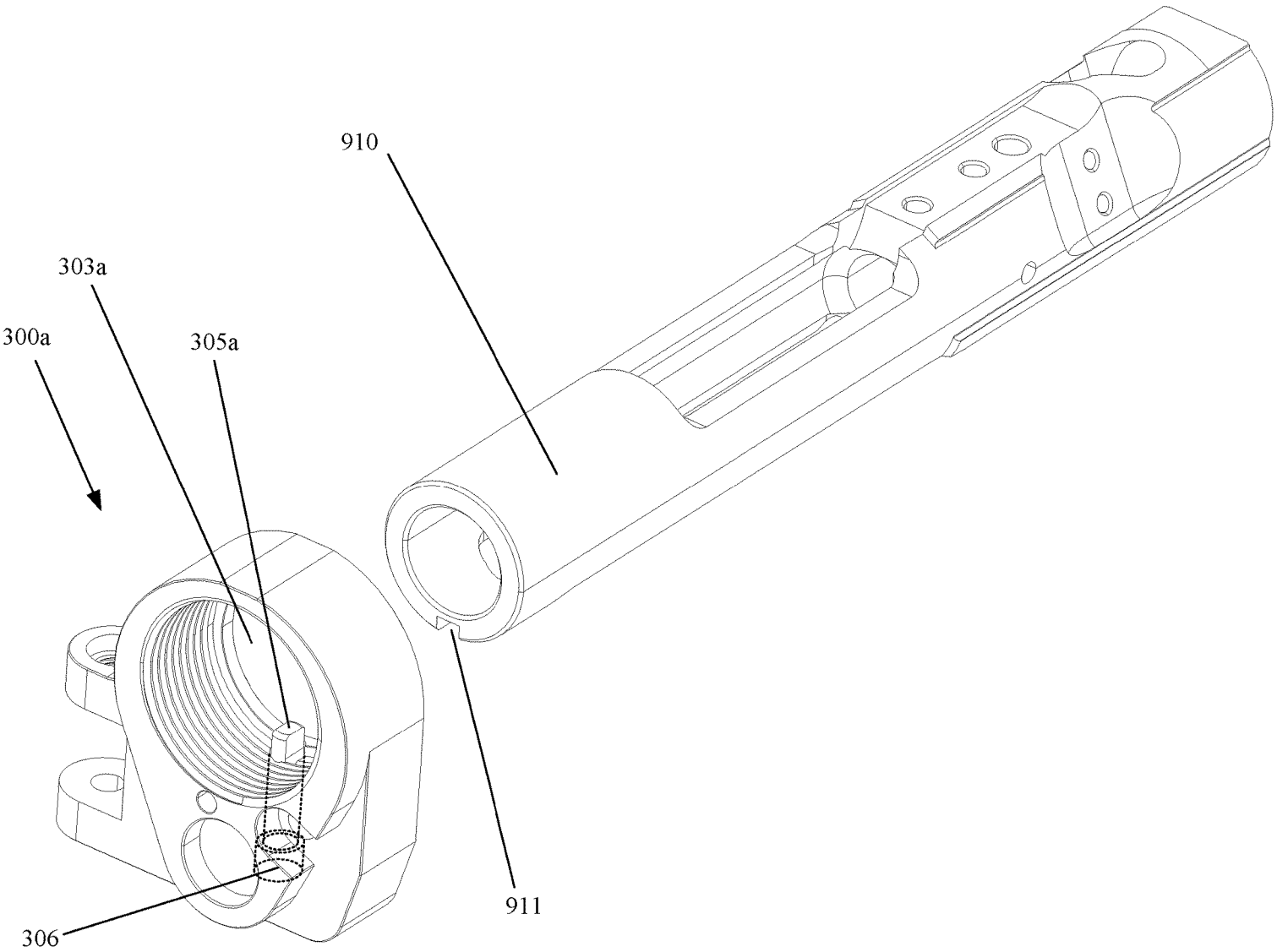
FIG. 12A is an isometric view of a buttstock side of a swinging hinge portion of a folding stock adapter and a bolt carrier group according to an exemplary embodiment of the invention.
Figures 12B, 12C:
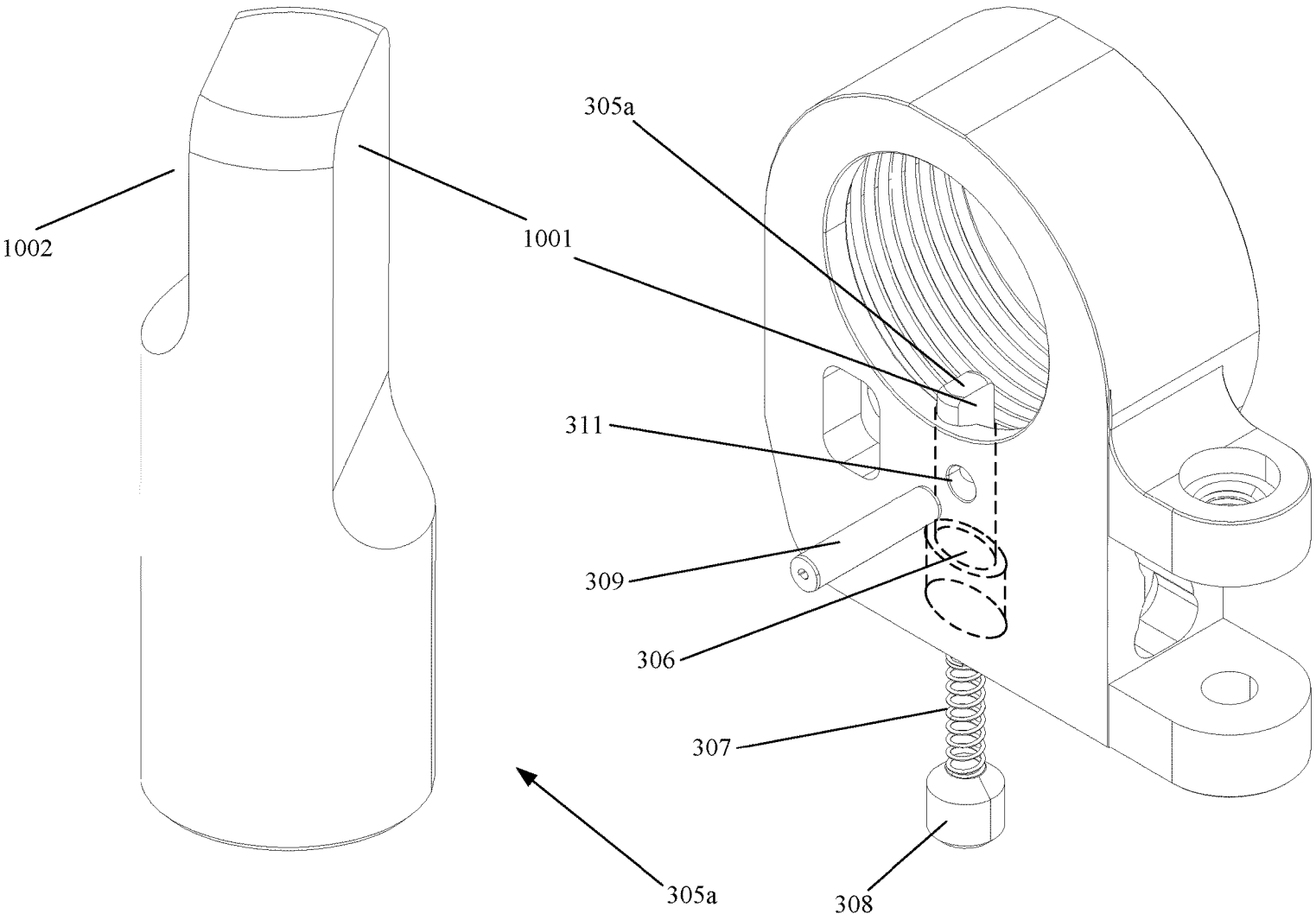
FIG. 12B is a view of a buffer retainer according to an exemplary embodiment of the invention.
FIG. 12C is an isometric view of an interface side of a swinging hinge portion of a of a folding stock adapter and a bolt carrier group according to an exemplary embodiment of the invention.

FIG. 12A is an isometric view of a buttstock side of a swinging hinge portion of a folding stock adapter and a bolt carrier group according to an exemplary embodiment of the invention, FIG. 12B is a view of a buffer retainer according to an exemplary embodiment of the invention, and FIG. 12C is an isometric view of an interface side of a swinging hinge portion of a of a folding stock adapter and a bolt carrier group according to an exemplary embodiment of the invention. Except for the swinging hinge portion 300*a* and the BCG 910, other components of the folding stock adapter are not shown for clarity. As shown in FIG. 12A, FIG. 12B, and FIG. 12C, BCG 910 can have notch 911. Swinging hinge portion 300*a* can have buffer hole 303*a* and buffer retainer 305*a* disposed in hole 306. In operation, when the folding stock adapter is in the closed position (as shown) and the rifle is fired, the BCG 910 can slide backwards through the folding stock adapter and through buffer hole 303*a*. Notch 911 can slide over buffer retainer 305*a*. When fully assembled, a buffer tube (not shown) can be threadably installed in buffer hole 303*a*. A buffer and spring can be installed into the buffer tube by moving buffer retainer 305*a* and inserting the buffer and spring through the interface side of the swinging hinge portion 300*a*.

Buffer retainer 305*a* can be captively retained in hole 306. Buffer retainer 305*a* can be substantially cylindrical with a narrowed head. The head of buffer retainer 305*a* can have flat portions 1001 and 1102. Flat portions 1001 and 1102 can be sized in approximate proportions to allow notch 911 of BCG 910 to slide over buffer retainer 305*a*. Flat portion 1001 can be taller or longer than flat portion 1002.

Hole 306 can be sized in approximate proportions to buffer retainer 305*a* such that buffer retainer 305*a* is slidably disposed in hole 306 with its head protruding into buffer hole 303*a*. Pin 309 can be inserted into pin hole 311. Pin hole 311 can be orthogonal to, and partially intersect hole 306. When pin 309 is inserted into pinhole 311, the pin 309 effectively narrows hole 306 such that the head of buffer retainer 305*a* can only pass pin 309 if a flat portion of the pin 309 is adjacent the pin 309 thereby ensure rotational orientation of buffer retainer 305*a* and retaining the buffer retainer 305*a* within hole 306. The length or height of flat portion 1001 can define a maximum penetration depth of the buffer retainer 305*a* into buffer hole 303*a*. The pin 309 can stop the buffer retainer 305*a* from sliding further into buffer hole 303*a* where the flat portion 1001 and the buffer retainer 305*a* is too large to slide past pin 309. Flat portion 1002 can be shorter than flat portion 1001 to provide additional stability to buffer retainer 305*a* within hole 306. A spring 307 and set screw 308 can be inserted into hole 306 after buffer retainer 305*a* to slidably retain buffer retainer 305*a* in hole 306 and spring bias buffer retainer 305*a* so that the head protrudes into buffer hole 303*a*. In such a configuration, a user can install or uninstall a buffer and buffer spring from the folding stock adapter for cleaning or adjustment purposes without tools by simply depressing the buffer retainer 305*a*.

Although the folding stock adapter has been shown and described in conjunction with the foregoing figures, those of skill in the art will appreciate that variations to the folding stock adapter as disclosed can be made and such variations would still be within the scope of the invention. By way of non-limiting example, the folding stock adapter has been shown and described as having a hinge on the left side but, the hinge and latch structures could be variously mirrored across to have right-side hinging folding stock adapter.

Other features have been shown or described to be in a particular location relative to the other structures but the location of such features should not be construed to be critical or limiting and those of skill in the art will appreciate that certain features can be moved, relocated, or resized and still be within the scope of the invention. Certain parts of the folding stock adapter have been disclosed to be "sized in relative proportions" to be compatible with, mate with, or otherwise work with other parts of the folding stock adapter. In the context of the specific part at issue, one part can be, for example, sized in relative proportions to be slidably received in another part if the first part is approximately the same shape and size as the other part. So, for example, a screw can be sized in relative proportions to be received into a correspondingly sized and threaded hole; a feature that slides can be sized in appropriately sized to slide in or on the surface which it is disclosed to cooperate with. In the drawings, some aspects of the invention have been simplified for the purposes of clarity of drawing. In one example, threaded parts of the invention may be illustrated as lacking threads (e.g. a set screw) even though the written description describes such parts as threaded and such variances in illustration are not intended to be limiting of the invention.

The invention has been shown and described in many embodiments, but the invention is not intended to be limited to the embodiments disclosed. Those of skill in the art will appreciate that features of the invention disclosed in the various embodiments can be combined into still other embodiments and such other embodiments are part of and within the scope of the invention. By way of non-limiting example, the larger BCG catch 701*a* of FIG. 10A and FIG. 10B could be substituted in place of the smaller BCG catch 700 of FIG. 7A and FIG. 7B and those of skill in the art would appreciate that the cutout 278 of FIG. 6A would be appropriately sized to accommodate the larger BCG catch 701*a*. In another example, the BCG extender 800*a* of FIG. 10A is disclosed to have hole 809 and those of skill in the art would appreciate that the benefits of hole 809 could be equally applied to BCG extender 800 of FIG. 8A.

The components of the invention can be formed from materials having appropriate properties for the function of the corresponding components. For example, the invention can be primarily formed from steel or aluminum alloys. Large parts such as body pieces can be formed from aluminum to reduce weight where strength is less important due to the expected forces or the size of the part indicates sufficient strength from aluminum. Small parts such as screws and latches can be formed from steel for strength and where the additional weight of steel would not be significant in view of the small size of the part. The fixed hinge portion and the swinging hinge are preferably formed from aluminum because these parts are large and benefit from the weight savings of aluminum but are also sufficiently large that the strength of aluminum is likely to bear anticipated forces without compromise or failure. In contrast, latch components are preferably formed from steel because they are small and may endure high forces where the additional weight of steel is inconsequential or less important and the corresponding strength of steel is advantageous for durability. Manufacturing efficiencies normally indicate fewer parts and fewer materials to reduce manufacturing time and complexity. Preferred embodiments of the invention, however, counsel to use different materials and separate parts for the swinging hinge portion and the bolt even though it may be less expensive and less complex to form the swinging hinge portion and the bolt from a single piece of material. Although reference has been made to steel and aluminum, it is anticipated that alloys of the foregoing will be selected by those of skill in the art having such properties as may be desirable to balance weight, strength, cost, machinability, availability, and durability. Although reference has been made primarily to steel and aluminum, the invention is not limited to the foregoing and materials can be selected from other metals and composites such as stainless steel, titanium, carbon fiber, plastic, and other materials as may be suitable based on the foregoing considerations.

It will be apparent to those skilled in the art that various modifications and variations can be made in the folding stock adapter without departing from the spirit or scope of the invention. Thus, it is intended that embodiments of the invention cover the modifications and variations of this invention provided they come within the scope of the appended claims and their equivalents.

What is claimed is:

1. A connector for hingedly mounting a buttstock to a receiver of a rifle, the connector comprising:

a fixed hinge portion;

a receiver side of the fixed hinge portion;

an interface side of the fixed hinge portion;

a threaded protrusion extending from the receiver side of the fixed hinge portion;

a buffer hole extending from the interface side, through the fixed hinge portion, and through the threaded protrusion;

a tube lock hole extending from the interface side, through the fixed hinge portion, to the receiver side; and a threaded plug sized in relative proportions to be threadably received in the tube lock hole.

2. The connector of claim 1 wherein the tube lock hole is smaller than the buffer hole.

3. The connector of claim 1 further comprising:

a takedown spring hole extending from the interface side, through the fixed hinge portion, to the receiver side; and a set screw sized in relative proportions to be threadably received in the takedown spring hole.

4. The connector of claim 3 wherein the takedown spring hole smaller than the tube lock hole.

5. The connector of claim 1 further comprising:

a first lateral side of the fixed hinge portion;

a second lateral side of the fixed hinge portion;

a hinge mount on the first lateral side;

a gate hole on the second lateral side partially intersecting the buffer hole; and a bolt hole on the interface side.

6. The connector of claim 5 further comprising:

a spring in the gate hole;

a gate slidably disposed in the gate hole; and a gate stop slidably retaining the gate in the gate hole.

7. A hinge for connecting a buttstock to a receiver of a rifle, the hinge comprising: a fixed hinge portion; a swinging hinge portion; a hinge pin rotably connecting the fixed hinge portion to the swinging hinge portion; a latch selectively connecting the fixed hinge portion to the swinging hinge portion, the latch comprising: a gate hole orthogonal to and on an opposite side from the hinge pin; a gate slidably disposed in the gate hole; a gate stop partially covering the gate hole retaining the gate in the gate hole; a bolt hole orthogonally intersecting the gate hole; a bolt sized in relative proportions to be received in the bolt hole and selectively retained by the gate; a receiver side of the fixed hinge portion; an interface side of the fixed hinge portion; a tube lock hole extending from the interface side, through the fixed hinge portion, to the receiver side; and a threaded plug sized in relative proportions to be threadably received in the tube lock hole.

8. The hinge of claim 7 further comprising:
a head of the hinge pin;
a cylindrical body of the hinge pin;
a threaded portion of the cylindrical body adjacent the head; and
a smooth portion of the cylindrical body opposite the head.

9. The hinge of claim 7 further comprising:
a recess of the swinging hinge portion, the bolt partially disposed in the recess;
a hole extending through the swinging hinge portion into the recess;
a screw connected to the bolt through the hole; and
wherein the bolt is formed from a different material than the swinging hinge portion.

10. The hinge of claim 7 further comprising: a lock screw sized in relative proportions to be threadably received in the tube lock hole.

11. The hinge of claim 10 further comprising:
a takedown spring hole extending from the interface side, through the fixed hinge portion, to the receiver side, the takedown spring hole smaller than the tube lock hole; and
a set screw sized in relative proportions to be threadably received in the takedown spring hole.

12. The hinge of claim 7 further comprising:
a buffer hole extending through the fixed hinge portion; and
a cutout in the buffer hole, the cutout formed from the orthogonal intersection of the gate hole with the buffer hole, the cutout extending more than 90 degrees of a perimeter of the buffer hole.

13. The hinge of claim 7 further comprising:
a bearing surface on one of the fixed hinge portion and the swinging hinge portion;
a hole on the other of the fixed hinge portion and the swinging hinge portion;
a spring in the hole; and
a cylindrical roller captively retained between the bearing surface and the spring.

14. The hinge of claim 13 further comprising:
a notch in the bearing surface sized in approximate proportions to receive the cylindrical roller; and
wherein when the swinging hinge portion is in an open position with respect to the fixed hinge portion, the spring pushes the cylindrical roller into the notch releasably securing the swinging hinge portion in the open position.

15. A connector for hingedly mounting a buttstock to a receiver of a rifle, the connector comprising: a fixed hinge portion; a receiver side of the fixed hinge portion; an interface side of the fixed hinge portion; a threaded protrusion extending from the receiver side of the fixed hinge portion; a buffer hole extending from the interface side, through the fixed hinge portion, and through the threaded protrusion; a threaded plug; a tube lock hole parallel to the buffer hole and extending from the interface side, through the fixed hinge portion, to the receiver side; and a takedown spring hole parallel to the buffer hole and extending from the interface side, through the fixed hinge portion, to the receiver side.

16. The connector of claim 15 wherein the tube lock hole is smaller than the buffer hole and wherein the takedown spring hole is smaller than the tube lock hole.

17. The connector of claim 15 further comprising: a cylindrical body of the threaded plug, the cylindrical body sized in relative proportions to be threadably received in the tube lock hole; a tool interface at a first end of the threaded plug; and a head at a second end of the threaded plug, the head having a larger diameter than the cylindrical body.

18. The connector of claim 15 further comprising:
a swinging hinge portion;
a hinge pin rotably connecting the fixed hinge portion to the swinging hinge portion;
a latch selectively connecting the fixed hinge portion to the swinging hinge portion, the latch comprising:
a gate hole orthogonal to and on an opposite side from the hinge pin;
a gate slidably disposed in the gate hole;
a gate stop partially covering the gate hole and slidably retaining the gate in the gate hole;
a bolt hole orthogonally intersecting the gate hole; and
a bolt sized in relative proportions to be received in the bolt hole and selectively retained by the gate.

19. The connector of claim 18 further comprising:
a buffer hole extending through the fixed hinge portion; and
a cutout in the buffer hole, the cutout formed from the orthogonal intersection of the gate hole with the buffer hole, the cutout extending more than 90 degrees of a perimeter of the buffer hole.

* * * * *